US010550345B2

(12) United States Patent
Berkhous et al.

(10) Patent No.: US 10,550,345 B2
(45) **Date of Patent: *Feb. 4, 2020**

(54) NATURAL GAS CONDENSATES IN FUEL COMPOSITIONS

(71) Applicant: ExxonMobil Research And Engineering Company, Annandale, NJ (US)

(72) Inventors: Scott K. Berkhous, Center Valley, PA (US); Sheryl B. Rubin-Pitel, Newtown, PA (US); Kenneth C. H. Kar, Philadelphia, PA (US); Erin R. Fruchey, Philadelphia, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/136,682

(22) Filed: Sep. 20, 2018

(65) Prior Publication Data

US 2019/0093032 A1 Mar. 28, 2019

Related U.S. Application Data

(60) Provisional application No. 62/561,775, filed on Sep. 22, 2017, provisional application No. 62/561,756,
(Continued)

(51) Int. Cl.
*C10L 1/04* (2006.01)
*C10L 1/16* (2006.01)
(Continued)

(52) U.S. Cl.
CPC ..... *C10L 1/1691* (2013.01); *C10L 1/02* (2013.01); *C10L 1/04* (2013.01); *C10L 1/08* (2013.01);
(Continued)

(58) Field of Classification Search
CPC combination set(s) only.
See application file for complete search history.

(56) References Cited

U.S. PATENT DOCUMENTS 2,425,506 A 8/1947 Bethea
2,916,446 A 12/1959 Shuman
(Continued)

OTHER PUBLICATIONS

Worrell et al., "Energy efficiency improvement and cost saving opportunities for petroleum refineries", Lawrence Berkeley National Laboratory, 2005.

(Continued)

*Primary Examiner* — Ellen M McAvoy
*Assistant Examiner* — Chantel L Graham
(74) *Attorney, Agent, or Firm* — Kristina Okafor; Anthony G. Boone; Robert A. Migliorini

(57) ABSTRACT

Compositions corresponding to marine diesel fuels, fuel oils, jet fuels, and/or blending components thereof are provided that include at least a portion of a natural gas condensate fraction. Natural gas condensate fractions derived from a natural gas condensate with sufficiently low API gravity can provide a source of low sulfur, low pour point blend stock for formation of marine diesel and/or fuel oil fractions. Natural gas condensate fractions can provide these advantages and/or other advantages without requiring prior hydroprocessing and/or cracking.

8 Claims, 6 Drawing Sheets

Related U.S. Application Data filed on Sep. 22, 2017, provisional application No. 62/561,766, filed on Sep. 22, 2017, provisional application No. 62/561,762, filed on Sep. 22, 2017, provisional application No. 62/561,737, filed on Sep. 22, 2017, provisional application No. 62/561,752, filed on Sep. 22, 2017.

(51) Int. Cl.

| | |
|---|---|
| ***C10L 1/08*** | (2006.01) |
| ***C10L 1/12*** | (2006.01) |
| ***C10L 3/06*** | (2006.01) |
| ***C10L 1/02*** | (2006.01) |
| ***C10L 3/10*** | (2006.01) |
| ***C10L 10/14*** | (2006.01) |

(52) U.S. Cl.

CPC ..... *C10L 1/1291* (2013.01); *C10L 3/06* (2013.01); *C10L 3/10* (2013.01); *C10L 10/14* (2013.01); *C10L 2200/0272* (2013.01); *C10L 2200/043* (2013.01); *C10L 2200/0415* (2013.01); *C10L 2200/0438* (2013.01); *C10L 2200/0446* (2013.01); *C10L 2200/0461* (2013.01); *C10L 2270/026* (2013.01); *C10L 2290/543* (2013.01); *C10L 2290/544* (2013.01)

(56) References Cited

U.S. PATENT DOCUMENTS

| | | | | |
|---|---|---|---|---|
| 3,172,841 | A * | 3/1965 | Paterson | C10G 47/00 208/79 |
| 3,529,944 | A | 9/1970 | Leas | |
| 4,645,585 | A * | 2/1987 | White | C10G 47/00 208/15 |
| 8,987,537 | B1 * | 3/2015 | Droubi | C10L 1/04 585/14 |
| 2002/0157305 | A1 * | 10/2002 | Hansen | C09K 8/524 44/385 |
| 2004/0020106 | A1 * | 2/2004 | Tack | C10L 1/143 44/393 |
| 2016/0298038 | A1 * | 10/2016 | Umansky | C10G 67/02 |

OTHER PUBLICATIONS

The International Search Report and Written Opinion of PCT/US2018/051949 dated Jan. 23, 2018.

The International Search Report and Written Opinion of PCT/US2018/051954 dated Nov. 23, 2018.

Reders et al., "Marine Fuels" In: "Ullman's Encyclopedia of Industrial Chemistry", 2005, Wiley-VCH.

* cited by examiner

NATURAL GAS CONDENSATES IN FUEL COMPOSITIONS

CROSS-REFERENCE TO RELATED APPLICATIONS

This application claims priority to U.S. Provisional Application Ser. No. 62/561,752 filed Sep. 22, 2017, which is herein incorporated by reference in its entirety.

FIELD

This invention relates to fuel compositions including natural gas condensates, such as marine fuel oils, marine gas oils, and jet fuels, and methods for forming such fuel compositions.

BACKGROUND

Marine fuel oil, sometimes referred to as bunker fuel, has traditionally provided a use for heavy oil fractions that are otherwise difficult and/or expensive to convert to a beneficial use. Due in part to a relatively high sulfur limit in international waters, vacuum resid fractions as well as other lightly processed (or even unprocessed) fractions can be incorporated into traditional fuel oils.

More recently, many countries have adopted local specifications for sulfur emissions from marine vessels. This can result in some vessels carrying two types of fuel oil, with one type being suitable for international waters while a second type can be used while satisfying the more stringent local regulations. As various local and international specifications continue to become more stringent, the development of additional methods for producing lower sulfur fuel oils and/or marine gas oils will become increasingly important.

U.S. Pat. Nos. 2,425,506, 2,916,446, and 3,529,944 provide early examples of the use of adsorptive clay structures for processing of petroleum fractions during production of jet fuels. The patents describe exposing petroleum fractions to adsorptive clay structures as a second (or later) processing step for removing contaminants from a potential jet fuel fraction. Examples of suitable adsorbent materials can include various types of natural and/or synthetic clays. The clays can correspond to treated or untreated clays. Examples of clays include attapulgite and/or other types of Fuller's earth. Silica gel can also potentially serve as a suitable adsorbent.

SUMMARY

Fractions derived from natural gas condensate can be used as fuels or fuel blending components for both distillate boiling range fuels (such as marine distillate or jet fuel) and resid boiling range fuels or fuel products. In various aspects, use of condensate fractions as a blend component can provide beneficial properties, such as unexpected improvements in cold flow properties for a fuel. Additionally or alternately, condensate fractions can contribute to forming a fuel with low carbon intensity, based on a reduced or minimized amount of processing needed for incorporation of condensate fractions into low sulfur products. Various condensate properties can also be useful for allowing unexpected combinations of blend products when attempting to form various types of fuel grades.

DETAILED DESCRIPTION OF THE EMBODIMENTS

Figure 1:
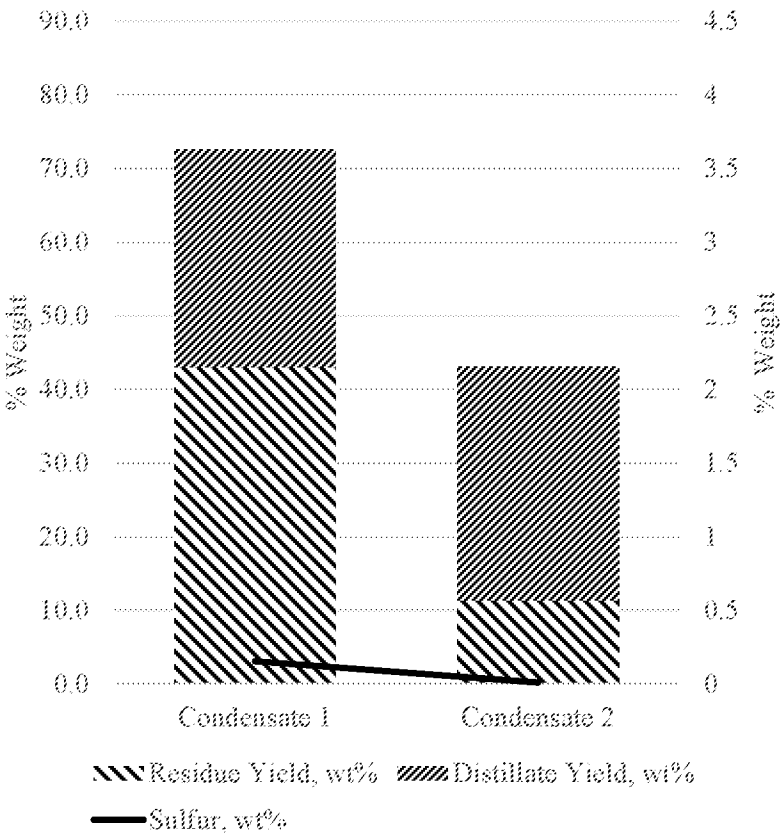
FIG. 1 shows compositional information for natural gas condensates.

In various aspects, marine diesel fuel/fuel blending component compositions and fuel oil/fuel blending component compositions are provided that include at least a portion of a natural gas condensate fraction. Natural gas condensate fractions derived from a natural gas condensate with sufficiently low API gravity can provide a source of low sulfur, low pour point blend stock for formation of marine diesel and/or fuel oil fractions. Natural gas condensate fractions can provide these advantages and/or other advantages without requiring prior hydroprocessing. Additionally, natural gas condensate fractions are likely to represent a petroleum source with increasing availability based on recent advances in development of natural gas formations. Thus, natural gas condensate fractions can provide a low cost source of marine diesel and/or fuel oil blend stock with beneficial properties. The beneficial properties can include one or more of good ignition quality, low sulfur, good low temperature operability (such as improved pour point), and improved compatibility with existing residual fuel oils relative to currently available ultra low sulfur fuel oils.

In various additional aspects, jet fuel (and/or jet fuel blending component) compositions are provided based on natural gas condensate fractions. In such additional aspects, condensate fractions with a suitable boiling range can be treated to form a jet fuel composition, such as by exposing the fraction to an adsorbent, such as attapulgite, Fuller's earth, or another type of adsorbent clay. This type of exposure can be referred to as "clay treating" of a potential jet fuel or fuel blending component.

Recent legislation and/or regulations have created Emission Control Areas in the coastal waters of various countries. In such Emission Control Areas, marine vessels are constrained to have emissions that correspond to the expected emissions from combustion of a low sulfur fuel oil having a sulfur content of roughly 0.1 wt % or less. Similarly, recent regulations have more generally set a global sulfur limit for fuel oil in the near future of 0.5 wt % or less. Currently, relatively few types of blend stocks are commercially available that satisfy this requirement. In part, the limited availability of suitable blend stocks for low sulfur fuel oils is based on the relatively high sulfur content of the traditional feeds used for fuel oil production. The typical vacuum resid feeds used for fuel oil production often have sulfur contents of 2 wt % or more. Performing sufficient processing on such feeds to generate a low (or ultra-low) sulfur fuel oil is generally not economically favorable.

Natural gas production from shale gas formations has increased significantly in the past 10 years. Associated with natural gas production are larger hydrocarbon molecules known as natural gas condensate. These liquids are co-produced with the natural gas either as a dissolved component, due to the temperature and pressure of the formation, or as liquids entrained in the gas flow. After extraction, the larger hydrocarbon molecules can be condensed from the gas phase, resulting in a natural gas condensate liquid. Typical natural gas condensates typically have API gravity values of 50 to 120. More generally, condensates are generally considered to correspond to crude oils with an API gravity of 50 or greater, or possibly 45 or greater.

In this discussion, natural gas condensates are defined as natural gas liquids that are part of a wet gas production stream that, as a result of a reduction of temperature and/or pressure, condense into a liquid prior to processing at a natural gas processing plant. A wet gas production stream is in contrast to a dry natural gas production stream. A dry natural gas production stream can have less than 0.1 gallons of condensable liquids per 1000 cubic feet of produced gas (roughly 1 liter per 70 cubic meters). In some aspects, a natural gas condensate can correspond to condensable liquids ($C_{5+}$) that are derived from an extraction source where 20 wt % or more (or 30 wt % or more, or 40 wt % or more) of the hydrocarbon product from the extraction source corresponds to methane.

It has been discovered that certain types of natural gas condensates can be beneficial sources of distillate and/or resid fractions for use in marine fuels. In some aspects, natural gas condensates with API gravity values of 60.0 or less, or 50.0 or less, or 45.0 or less, or 42.0 or less, or 40.0 or less, can have beneficial properties relative to typical natural gas condensates. Additionally or alternately, natural gas condensates where 5 wt % or more of the condensate has a distillation point greater than 350° C. can have beneficial properties relative to a typical natural gas condensate, or 10 wt % or more, or 20 wt % or more, or 30 wt % or more. Additionally or alternately, natural gas condensates having a kinematic viscosity at 40° C. of 2.0 cSt or more, or 4.0 cSt or more, or 6.0 cSt or more can have beneficial properties relative to typical natural gas condensates.

Natural gas condensate is often considered a waste product by natural gas production sites. The separated condensate is typically either sold as a diluent to improve flow properties of heavy crude oils or burnt on site to generate heat or power. It has been discovered, however, that the heavier portions of a natural gas condensate can be beneficially used as fuel products and/or fuel blending components for fuel products. After distillation to produce a desired fraction, a natural gas condensate fraction can be suitable for incorporation into fuel and/or fuel blending product. For example, distillate boiling range and resid boiling range fractions derived from natural gas condensate can potentially be suitable for incorporation into marine diesel fuel products and/or fuel oil products. Due to the low sulfur content of natural gas condensate fractions, in some aspects the natural gas condensate fractions can be suitable for incorporation into low sulfur fuel oils or ultra low sulfur fuel oils with only minimal processing other than distillation. In some aspects, a natural gas condensate fraction that is incorporated into a fuel or fuel blending product can correspond to a natural gas condensate fraction that has not been hydroprocessed and/or that has not been cracked. In this discussion, a non-hydroprocessed fraction is defined as a fraction that has not been exposed to more than 10 psia of hydrogen in the presence of a catalyst comprising a Group VI metal, a Group VIII metal, a catalyst comprising a zeolitic framework, or a combination thereof. In this discussion, a non-cracked fraction is defined as a fraction that has not been exposed to a temperature of 400° C. or more. Optionally, hydroprocessing could be performed on a natural gas condensate fraction to facilitate use in an ultra-low sulfur fuel.

In various aspects, condensate fractions can be beneficial as low carbon intensity blending components for forming fuels. Low carbon intensity for a fraction used as a fuel or fuel blending component can refer to a) a reduced or minimized amount of processing that is needed for the fraction to be suitable as a fuel or blending component; b) a fraction that allows other components in a blend to be processed at reduced or minimized intensity; c) a fraction that has a low ratio of carbon to hydrogen; or d) a combination thereof. As an example, a condensate fraction with a low sulfur content can be used as a blending component in various fuels without requiring hydroprocessing and/or cracking in order to reduce the sulfur content of the fraction. This saves on the energy costs required for the condensate fraction to be suitable for incorporation into a fuel, and therefore reduces the overall carbon intensity of the fuel. Additionally, the low sulfur content of a condensate fraction may allow other blend components in a fuel to be suitable at higher sulfur contents while still achieving an overall desired sulfur target for a fuel. This corresponds to an additional reduction in the energy required for processing the blend components of the fuel, leading to a reduction in carbon intensity.

In various aspects, a natural gas condensate fraction can be included as part of a fuel or fuel blending product. For convenience, unless otherwise specified, it is understood that references to incorporation of a natural gas condensate fraction into a fuel also include incorporation of such a fraction into a fuel blending product.

For a fuel in the distillate boiling range (such as a marine gas oil), a natural gas condensate distillate fraction can be incorporated into the fuel. In some aspects, a natural gas condensate distillate fraction can potentially be used "as is" as a fuel or fuel blending component, so that the natural gas condensate distillate fraction corresponds to 95 vol % or more of a fuel, or 98 vol % or more, or 99 vol % or more. Additionally or alternately, the amount of natural gas condensate distillate fraction can correspond to 5 vol % to 100 vol % of the fuel, or 5 vol % to 90 vol %, or 5 vol % to 75 vol %, or 5 vol % to 50 vol %, or 25 vol % to 75 vol %, or 40 vol % to 90 vol %. Optionally, the amount of natural gas condensate distillate fraction in a distillate fuel can correspond to 15 vol % or more, such as 15 vol % to 100 vol %, or 15 vol % to 90 vol %, or 15 vol % to 75 vol %. In some aspects, a distillate boiling range fuel can also include 5 vol % or more of a hydroprocessed distillate fraction, a cracked distillate fraction, or a combination thereof. For example, the distillate boiling range fuel can include 5 vol % to 95 vol % (15 vol % to 90 vol %) of a hydroprocessed distillate fraction and/or 5 vol % to 65 vol % (or 15 vol % to 65 vol %) of a cracked gas oil fraction. Optionally, the distillate boiling range fraction can include 10 vol % or less of a hydroprocessed distillate boiling range fraction, or 5 vol % or less. Optionally, the distillate boiling range fraction can include 10 vol % or less of a cracked distillate boiling range fraction, or 5 vol % or less. Such a distillate boiling range fuel can have a density at 15° C. of 900 kg/m$^3$ or less, or 850 kg/m$^3$ or less, or 835 kg/m$^3$ or less, or 820 kg/m$^3$ or less, such as down to 800 kg/m$^3$ or possibly still lower. Additionally or alternately, the sulfur content can be 10,000 wppm or less, or 5000 wppm or less, or 1000 wppm or less, or 500 wppm or less, such as down to 100 wppm or possibly still lower. Additionally or alternately, the cetane index of the distillate boiling range fuel can be 35 to 65, or 40 to 60, or 45 to 60, or 50 to 65.

For a fuel in the resid boiling range (such as a marine fuel oil), a natural gas condensate distillate fraction and/or a natural gas condensate resid fraction can be incorporated into the fuel. The amount of natural gas condensate distillate fraction can correspond to 5 vol % to 60 vol % of the fuel (or possibly still higher), or 5 vol % to 15 vol %, or 10 vol % to 40 vol %, or 20 vol % to 60 vol %. Such a resid boiling range fuel can also include 50 vol % or more of a hydroprocessed resid fraction. For example, the resid boiling range fuel can include 50 vol % to 95 vol % of a hydroprocessed resid fraction, or 50 vol % to 75 vol %, or 65 vol % to 95 vol %, or 85 vol % to 95 vol %. Such a resid boiling range fuel can have a density at 15° C. of 900 kg/m$^3$ or less, or 875 kg/m$^3$ or less, or 860 kg/m$^3$ or less, such as down to 830 kg/m$^3$ or possibly still lower. Additionally or alternately, the sulfur content can be 20,000 wppm or less, or 10,000 wppm or less, or 5000 wppm or less, or 1000 wppm or less, such as down to 100 wppm or possibly still lower. Additionally or alternately, the CCAI (calculated carbon aromaticity index) of the resid boiling range fuel can be 750 to 825, or 750 to 800. Additionally or alternately, the pour point can be 0° C. or less, or −5° C. or less, or −10° C. or less, or −15° C. or less, such as down to −30° C. or less or possibly still lower.

For a fuel in the resid boiling range, a natural gas condensate resid fraction can potentially be used "as is" as a resid boiling range fuel or fuel blending component, so that the natural gas condensate resid fraction corresponds to 95 vol % or more of a fuel, or 98 vol % or more, or 99 vol % or more. Additionally or alternately, the amount of natural gas condensate resid fraction can correspond to 5 vol % to 95 vol % of the fuel, or 5 vol % to 50 vol %, or 25 vol % to 75 vol %, or 40 vol % to 95 vol %. Such a resid boiling range fuel can also include 5 vol % or more of a hydroprocessed distillate fraction, a hydroprocessed resid fraction, a cracked distillate fraction, or a combination thereof. For example, the resid boiling range fuel can include 5 vol % to 65 vol % of a hydroprocessed distillate fraction and/or 5 vol % to 95 vol % of a hydroprocessed resid fraction and/or 5 vol % to 50 vol % of a cracked gas oil fraction. Optionally, the resid boiling range fraction can include 10 vol % or less of a hydroprocessed distillate boiling range fraction, or 5 vol % or less. Optionally, the resid boiling range fraction can include 10 vol % or less of a hydroprocessed resid boiling range fraction, or 5 vol % or less. Optionally, the resid boiling range fraction can include 10 vol % or less of a cracked distillate boiling range fraction, or 5 vol % or less. Such a resid boiling range fuel can have a density at 15° C. of 920 kg/m$^3$ or less, or 900 kg/m$^3$ or less, or 875 kg/m$^3$ or less, such as down to 830 kg/m$^3$ or possibly still lower. Additionally or alternately, the sulfur content can be 20,000 wppm or less, or 10,000 wppm or less, or 5000 wppm or less, or 1000 wppm or less, such as down to 100 wppm or possibly still lower. Additionally or alternately, the CCAI (calculated carbon aromaticity index) of the resid boiling range fuel can be 750 to 825, or 750 to 800. Additionally or alternately, the pour point can be 24° C. or less, or 0° C. or less, or −5° C. or less, or −10° C. or less, such as down to −30° C. or less or possibly still lower.

In aspects wherein a resid boiling range fuel incorporates a hydroprocessed resid boiling range fraction (such as a commercially available fuel oil), the hydroprocessed resid boiling range fraction can have a kinematic viscosity at 50° C. of 200 cSt or less, or 180 cSt or less. Additionally or alternately, the resid boiling range fuel or fuel product can have a kinematic viscosity at 50° C. of 200 cSt or less, or 180 cSt or less, or 25 cSt or less, or 20 cSt or less.

A natural gas condensate resid fraction can have a relatively low weight ratio of carbon atoms to hydrogen atoms for a resid boiling range fraction. The carbon atom to hydrogen atom weight ratio for the condensate resid fraction can be 7.0 or less, or 6.8 or less, such as down to 6.0 or possibly still lower. The low ratio of carbon atoms to hydrogen atoms in the condensate resid fraction can assist with forming a fuel oil with a weight ratio of carbon atoms to hydrogen atoms of 7.3 or less, or 7.0 or less, such as down to 6.3 or possibly still lower. In some aspects, the condensate resid fraction can correspond to a fraction having an aromatics content of 30 wt % or more, or 35 wt % or more. In some aspects, the condensate resid fraction can be enriched in saturates, such as having a saturates content of 70 wt % or more, or 80 wt % or more. A condensate fraction enriched in saturates can have an isoparaffin content of 30 wt % or more, or 40 wt % or more. Additionally or alternately, a condensate resid fraction can have a density at 15° C. of 925 kg/m$^3$ or less, or 875 kg/m$^3$ or less.

In some aspects, a fuel in the resid boiling range (such as a marine fuel oil) can correspond to a blend of a plurality of natural gas condensate resid fractions. The blend can include 5 vol % or more of each resid fraction. Optionally, the blend can further include one or more natural gas condensate distillate fractions. Such a resid boiling range fuel can have a density at 15° C. of 920 kg/m$^3$ or less, or 900 kg/m$^3$ or less, or 875 kg/m$^3$ or less, such as down to 830 kg/m$^3$ or possibly still lower. Additionally or alternately, the sulfur content can be 5000 wppm or less, or 1000 wppm or less, or 500 wppm or less, such as down to 100 wppm or possibly still lower. Additionally or alternately, the CCAI (calculated carbon aromaticity index) of the resid boiling range fuel can be 750 to 800. Optionally, a first condensate resid fraction can correspond to a fraction including 30 wt % or more of aromatics (or 35 wt % or more) while a second condensate resid fraction can correspond to a fraction including 70 wt % or more saturates (or 75 wt % or more).

For a fuel in the jet fuel boiling range, a natural gas condensate jet boiling range fraction can be incorporated into the fuel. In some aspects, a natural gas condensate jet fraction can potentially be used "as is" as a fuel or fuel blending component, so that the natural gas condensate jet fraction corresponds to 95 vol % or more of a fuel, or 98 vol % or more, or 99 vol % or more. Additionally or alternately, the amount of natural gas condensate jet fraction can correspond to 5 vol % to 100 vol % of the fuel, or 5 vol % to 90 vol %, or 5 vol % to 75 vol %, or 5 vol % to 50 vol %, or 25 vol % to 75 vol %, or 40 vol % to 90 vol %. In some aspects, such a jet boiling range fuel can also include 10 vol % or more of a hydroprocessed jet boiling range fraction, a cracked jet boiling range fraction, or a combination thereof. Optionally, the jet boiling range fraction can include 10 vol % or less of a hydroprocessed jet boiling range fraction, or 5 vol % or less. Such a jet boiling range fuel can have a density at 15° C. of 900 kg/m$^3$ or less, or 850 kg/m$^3$ or less, or 835 kg/m$^3$ or less, or 820 kg/m$^3$ or less, such as down to 800 kg/m$^3$ or possibly still lower. Additionally or alternately, the sulfur content can be 10,000 wppm or less, or 5000 wppm or less, or 1000 wppm or less, or 500 wppm or less, such as down to 100 wppm or possibly still lower. Additionally or alternately, the cetane index of the jet boiling range fuel can be 35 to 65, or 40 to 60, or 45 to 60, or 50 to 65.

Clay treatment, or more generally exposure of a jet fuel sample to an adsorbent, can be used to remove a variety of types of impurities from a sample. Suitable adsorbents can include, but are not limited to, natural and/or synthetic clays, Fuller's earth, attapulgite, and silica gels. Such adsorbents are commercially available in various particle sizes and surface areas. It is noted that the effectiveness of an adsorbent for reducing the content of nitrogen/nitrogen compounds in a sample can be dependent on the affinity of the adsorbent for a given compound and/or the prior usage history of the adsorbent. For example, exposing a jet boiling range fraction to a clay adsorbent that is loaded with basic nitrogen compounds (such as due to prior adsorption from other kerosene boiling range samples) may result in exchange of nitrogen compounds from the current kerosene boiling range sample for previously adsorbed nitrogen compounds. Similar adsorption/desorption type processes may also occur for other polar compounds that have previously been absorbed by the absorbent.

The conditions employed during clay treatment (or other adsorbent treatment) can vary over a broad range. Treatment with adsorbent can generally be carried out in a temperature range of 0° C.-100° C. and preferably near ambient conditions, such as 20° C.-40° C., for a period of time generally ranging from ~1 second to ~1 hour. The jet fuel sample can be exposed to the adsorbent in a packed column at any convenient pressure.

Definitions

All numerical values within the detailed description and the claims herein are modified by "about" or "approximately" the indicated value, and take into account experimental error and variations that would be expected by a person having ordinary skill in the art.

In this discussion, a natural gas condensate is defined as a petroleum product extracted from a natural gas petroleum source and condensed out from the natural gas. A natural gas condensate fraction is defined as a boiling range fraction of a natural gas condensate.

Unless otherwise specified, distillation points and boiling points can be determined according to ASTM D2887. For samples that are not susceptible to characterization using ASTM D2887, D7169 can be used. It is noted that still other methods of boiling point characterization may be provided in the examples. The values generated by such other methods are believed to be indicative of the values that would be obtained under ASTM D2887 and/or D7169. In this discussion, the distillate boiling range is defined as 170° C. to 350° C. A distillate boiling range fraction is defined as a fraction having a T10 distillation point of 170° C. or more and a T90 distillation point of 350° C. or less. In some aspects, a narrower distillate boiling range definition can be used, so that a distillate boiling range fraction has a T5 distillation point of 170° C. or more and a T95 distillation point of 350° C. or less. The resid boiling range is defined as 350° C. and higher. A resid boiling range fraction is defined as a fraction having a T10 distillation point of 350° C. or more. In some aspects, a narrower resid boiling range definition can be used, so that a resid boiling range fraction has a T5 distillation point of 350° C. The jet boiling range is defined as corresponding to an initial boiling point of 140° C. or more, a T10 distillation point of 205° C. or less and a final boiling point of 300° C. or less.

In this discussion, a hydroprocessed fraction refers to a hydrocarbon fraction and/or hydrocarbonaceous fraction that has been exposed to a catalyst having hydroprocessing activity in the presence of 300 kPa-a or more of hydrogen at a temperature of 200° C. or more. Examples of hydroprocessed fractions include hydroprocessed distillate fractions (i.e., a hydroprocessed fraction having the distillate boiling range) and hydroprocessed resid fractions (i.e., a hydroprocessed fraction having the resid boiling range). It is noted that a hydroprocessed fraction derived from a biological source, such as hydrotreated vegetable oil, can correspond to a hydroprocessed distillate fraction and/or a hydroprocessed resid fraction, depending on the boiling range of the hydroprocessed fraction. If specified, a hydroprocessed condensate fraction can be excluded from the definition of a hydroprocessed fraction.

In this discussion, a cracked fraction refers to a hydrocarbon and/or hydrocarbonaceous fraction that is derived from the effluent of a thermal cracking or catalytic cracking process. A cracked distillate fraction (having the distillate boiling range), such as a light cycle oil from a fluid catalytic cracking process, is an example of a cracked fraction.

With regard to characterizing properties of distillate boiling range condensate fractions and/or blends of such fractions with other components to form distillate fuels, a variety of methods can be used. Density of a blend at 15° C. (kg/m$^3$) can be determined according ASTM D4052. Sulfur (in wppm) can be determined according to ASTM D2622. Kinematic viscosity at either 40° C. or 50° C. (in cSt) can be determined according to ASTM D445. Cetane index for a condensate distillate fraction or a marine gas oil can be calculated according to ASTM D4737, Procedure A.

For blends to form marine fuel oils, density (in kg/m$^3$) can be determined according to ISO 3675. For blends to form marine fuel oils, sulfur (in wppm) can be determined according to ISO 8754. For blends to form marine fuel oils, kinematic viscosity at 50° C. (in cSt) can be determined according ISO 3104. For blends to form marine fuel oils, pour point can be determined according to ISO 3016. For blends to form marine fuel oils, sediment can be determined according to ISO 10307-2. CCAI (calculated carbon aromaticity index) can be determined according Equation F.1 in ISO 8217:2012. For resids, fuel oils, and other types of fractions, API gravity can be determined according to ASTM D1298.

With regard to characterizing properties of jet boiling range condensate fractions and/or blends of such fractions with other components to form jet fuels, a variety of methods can be used. In some aspects, methods can be selected that are consistent with ASTM D1655. Density of a blend at 15° C. (kg/m$^3$) can be determined according ASTM D4052. Sulfur (in wppm) can be determined according to ASTM D2622. Kinematic viscosity at either −20° C. (in cSt) can be determined according to ASTM D445. Smoke point can be determined according to ASTM D1322. Freeze point can be determined according to ASTM D2386. Derived cetane number can be calculated according to ASTM D7668. JFTOT™ Thermal Stability can be determined according to ASTM D3241.

Characterization of Natural Gas Condensate Fractions

Natural gas condensates were obtained from two different natural gas extraction sources. The condensates were fractionated to generate natural gas condensate fractions from each condensate, including natural gas condensate resid fractions, natural gas condensate distillate fractions, natural gas condensate jet fractions, and natural gas condensate naphtha fractions. The natural gas condensate resid fractions had a T5 distillation point of 350° C. or more and a final boiling point of roughly 600° C. The natural gas condensate distillate fractions had a T5 distillation point of 170° C. or more and a T95 distillation point of 350° C. or less. The natural gas condensate jet fractions had a T5 distillation point of 149° C. or more and a T95 distillation point of 288° C. or less. The natural gas condensate naphtha fractions had a T5 distillation point of 29° C. or more and a T95 distillation point of 193° C. or less.

Table 1 shows an example of the properties of the neat condensates after extraction. As shown in Table 1, Condensate 1 has an unexpectedly low API gravity of 39.4, meaning Condensate 1 has an API gravity of 45.0 or less, or 42.0 or less, or 40.0 or less. Condensate 1 additionally has an unexpectedly high kinematic viscosity at 40° C. of 6.79 (i.e., a kinematic viscosity at 40° C. of 2.0 or more, or 4.0 or more, or 6.0 or more, such as up to 10 or possibly still higher). Condensate 1 further has a T50 distillation point of ~250° C. or more and a T90 distillation point of ~500° C. or more. Condensate 2 also has a relatively low API gravity of 57.9, a T90 distillation point of nearly 350° C., and a kinematic viscosity at 40° C. of greater than 1.0. Thus, both Condensate 1 and Condensate 2 are heavier than typical condensates, with Condensate 1 being unexpectedly heavy relative to conventional understanding of condensate properties. The condensates are also relatively low in sulfur content, with Condensate 1 having a sulfur content of roughly 1500 wppm and Condensate 2 having a sulfur content of roughly 100 wppm. Both condensates also have pour points of −50° C. or less.

TABLE 1

Properties of Neat Condensates

| Property | Method | Unit | Condensate 1 | Condensate 2 |
|---|---|---|---|---|
| T10 | GC Distillation | ° C. | 81.7 | 55.8 |
| T50 | GC Distillation | ° C. | 255.4 | 143.7 |
| T90 | GC Distillation | ° C. | 500.4 | 347.1 |
| API Gravity | ASTM D1298 | — | 39.4 | 57.9 |
| Kinematic Viscosity, 40° C. | ASTM D445 | cSt | 6.79 | 1.165 |
| Sulfur Content | ASTM D2622 | mass % | 0.155 | 0.011 |
| Pour Point | ASTM D97 | ° C. | −51 | <−60 |

Figure 2:
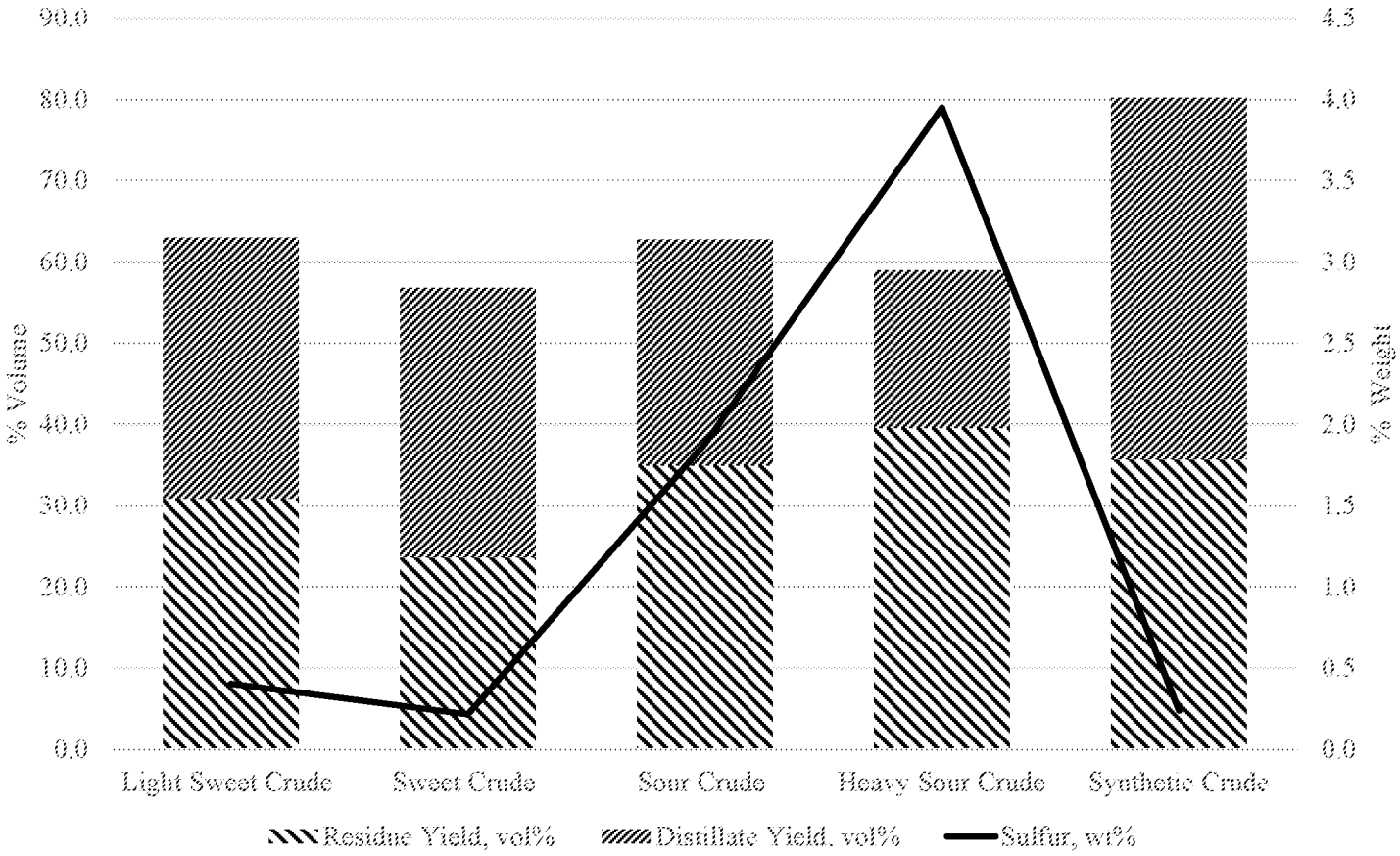
FIG. 2 shows compositional information for crude oils from various sources.

FIG. 1 provides additional information regarding the condensates in Table 1. In FIG. 1, the weight percentage of Condensate 1 and Condensate 2 that corresponds to distillate boiling range and resid boiling range fractions is shown, along with the sulfur content. For comparison, FIG. 2 provides similar comparative compositional information for crudes from several crude sources. As indicated in FIG. 2, the additional crude sources correspond to a light sweet crude, a (medium) sweet crude, a (medium) sour crude, a heavy sour crude, and a synthetic crude formed from an oil sands source. In FIG. 1, the left-hand axis corresponds to the wt % for the distillate boiling range and resid boiling range fractions within each sample while the right-hand axis corresponds to the sulfur content for the respective distillate and resid fractions of each sample. In FIG. 2, the left-hand axis corresponds to the vol % for the distillate boiling range and resid boiling range fractions within each sample while the right-hand axis corresponds to the sulfur content for the respective distillate and resid fractions of each sample. As shown in FIGS. 1 and 2, the condensate distillate and resid fractions have low sulfur contents, even in comparison with fractions derived from conventional low sulfur crude sources shown in FIG. 2. FIG. 1 also shows that the distillate and resid fractions of the condensates represent substantial portions of the total condensate volume. It is noted that more than 50 vol % of Condensate 1 corresponds to distillate and resid boiling range fractions.

Table 2 provides additional composition information for resid fractions derived from the condensates in Table 1, based on field ionization mass spectrometry (FIMS) analysis. As shown in Table 2, the resid fractions from both Condensate 1 and Condensate 2 include compounds having up to 72 carbons. This is somewhat unexpected for condensate derived from a petroleum source corresponding primarily to natural gas. Condensate 1 includes 50 wt % aromatics or more, or 60 wt % or more, while Condensate 2 includes greater than 80 wt % of saturates. A substantial portion of the saturates in Condensate 2 correspond to paraffins (greater than 30 wt %).

TABLE 2

Compositional Analysis of Resid Boiling Range Fractions

| Composition, wt % | | Condensate 1 | Condensate 2 |
|---|---|---|---|
| Saturates | Total Saturates | 40% | 82% |
| | Alkanes | 14.5 | 32.4 |
| | 1 Ring | 12.5 | 28.9 |
| | 2 Ring | 6.2 | 11.3 |
| | 3 Ring | 3.0 | 4.4 |
| | 4 Ring | 2.8 | 3.4 |
| | 5 Ring | 1.2 | 1.3 |
| | 6 Ring | 0.4 | 0.3 |
| | Carbon Number | C15-C69 | C15-C67 |
| Aromatics | Total Aromatics | 60% | 18% |
| | Alkyl benzenes | 9.3 | 3.2 |
| | Indanes | 10.2 | 3.2 |
| | Indenes | 8.9 | 2.7 |
| | Naphthalenes | 9.0 | 2.7 |
| | Acenaphthalenes | 8.7 | 2.5 |
| | Acenaphthalenes/Fluorenes | 7.1 | 2.0 |
| | Phenanthrenes | 6.2 | 1.7 |
| | Carbon Number | C9-C72 | C9-C72 |

Table 3 shows additional characterization of the condensate resid fractions. As shown in Table 3, the condensate resid fractions have good ignition quality (CCAI value of 790 or less) relative to while also having an unexpectedly low pour point (15° C. or less, or 10° C. or less) for a fraction prior to any hydroprocessing and/or addition of additives. This indicates that the condensate resid fractions can potentially be suitable for use as fuel oil blending components that have the ability to improve ignition quality, sulfur content, and/or pour point for fuel oil product. It is noted that the condensate resid fraction from Condensate 1 includes little or no sediment, while the condensate resid fraction from Condensate 2 is roughly at the sediment limit of 0.1 wt %.

TABLE 3

Resid Boiling Range Fractions

| | Property | | |
|---|---|---|---|
| | Unit | Condensate 1 | Condensate 2 |
| Density at 15.6° C. (D4052) | kg/m$^3$ | 912 | 856 |
| Sulfur Content (D2622) | mg/kg | 3250 | 685 |
| Kinematic Viscosity at 50° C. (D445) | cSt | 164.8 | 24.1 |
| CCAI | — | 783 | 755 |
| Carbon Residue (D4530) | mass % | 2.89 | 0.23 |
| Total Sediment Aged | mass % | <0.01 | 0.1 |
| Asphaltenes | mass % | <0.5 | <0.5 |
| Pour Point (D97) | ° C. | 9 | 12 |

TABLE 3-continued

| Resid Boiling Range Fractions | | | |
|---|---|---|---|
| | Property | | |
| | Unit | Condensate 1 | Condensate 2 |
| GC Distillation | | | |
| T10 | ° C. | 366 | 352 |
| T50 | ° C. | 483 | 442 |
| T90 | ° C. | 652 | 583 |
| Sodium | mg/kg | 4 | 1.6 |
| Vanadium | mg/kg | 6.8 | 1.2 |

As shown in Table 3, the condensate resid fractions have a T10 distillation point of 350° C. or more, or 360° C. or more, such as up to 380° C. or possibly still higher. The condensate resid fractions have a kinematic viscosity at 50° C. of 20 cSt or more, or 50 cSt or more, or 100 cSt or more, or 150 cSt or more, such as up to 250 cSt or possibly still higher. The condensate resid fractions have a density at 15.6° C. of 850 kg/m$^3$ or more, or 880 kg/m$^3$ or more, or 900 kg/m$^3$ or more. It is further noted that, with regard to Table 2, the condensate resid fractions have a T50 distillation point of 440° C. or more, or 460° C. or more, or 480° C. or more and/or a T90 distillation point of 580° C. or more, or 620° C. or more, or 650° C. or more. In some aspects, a resid condensate fraction can have a sulfur content of 5000 wppm or less, 1000 wppm or less, or 700 wppm or less, such as down to 100 wppm or less or possibly still lower.

It is noted that condensate resid fractions have unexpectedly low weight ratios of carbon atoms to hydrogen atoms. The condensate resid fraction from Condensate 1 has a weight ratio of carbon atoms to hydrogen atoms of 6.8, while the resid fraction from Condensate 2 has a weight ratio of carbon atoms to hydrogen atoms of 6.2. This is comparable to the weight ratio for a commercial diesel (roughly 6.6). As a comparison, the paraffinic ultra-low sulfur fuel oil HDME 50 has a weight ratio of carbon atoms to hydrogen atoms of 7.1. Typical residual fuel oils can have still higher weight ratios of carbon atoms to hydrogen atoms, ranging from 7.5 to 8.0 or possibly more. Weight ratios of carbon atoms to hydrogen atoms can be determined according to the methods in ASTM D5291.

Figure 3:
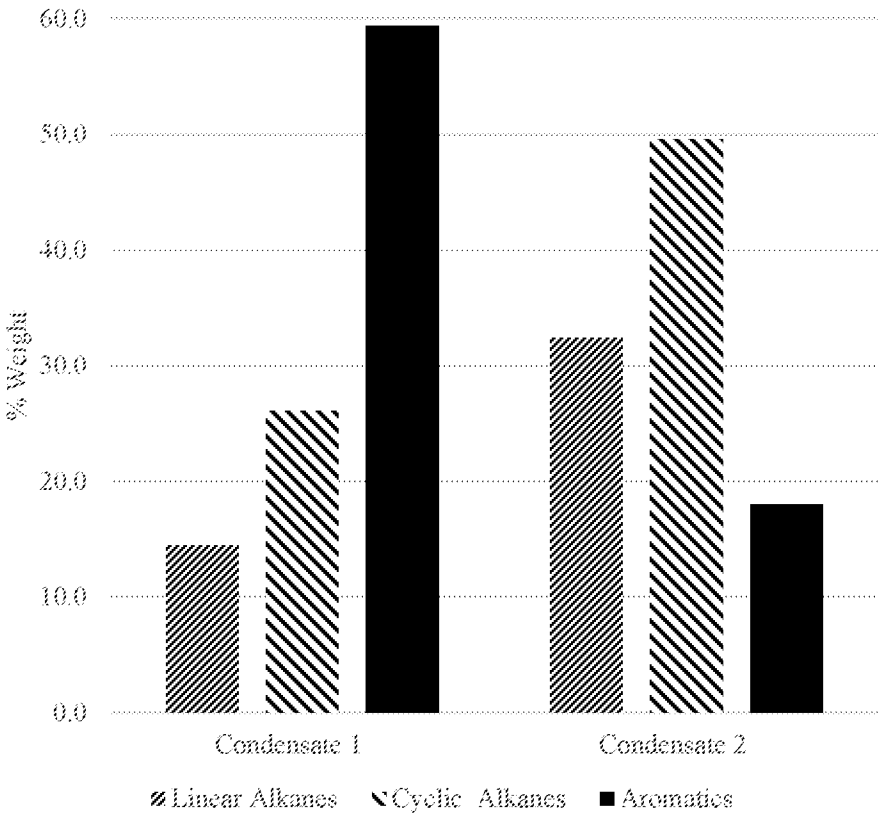
FIG. 3 provides additional compositional information for resid boiling range fractions derived from the condensates shown in FIG. 1.
Figure 4:
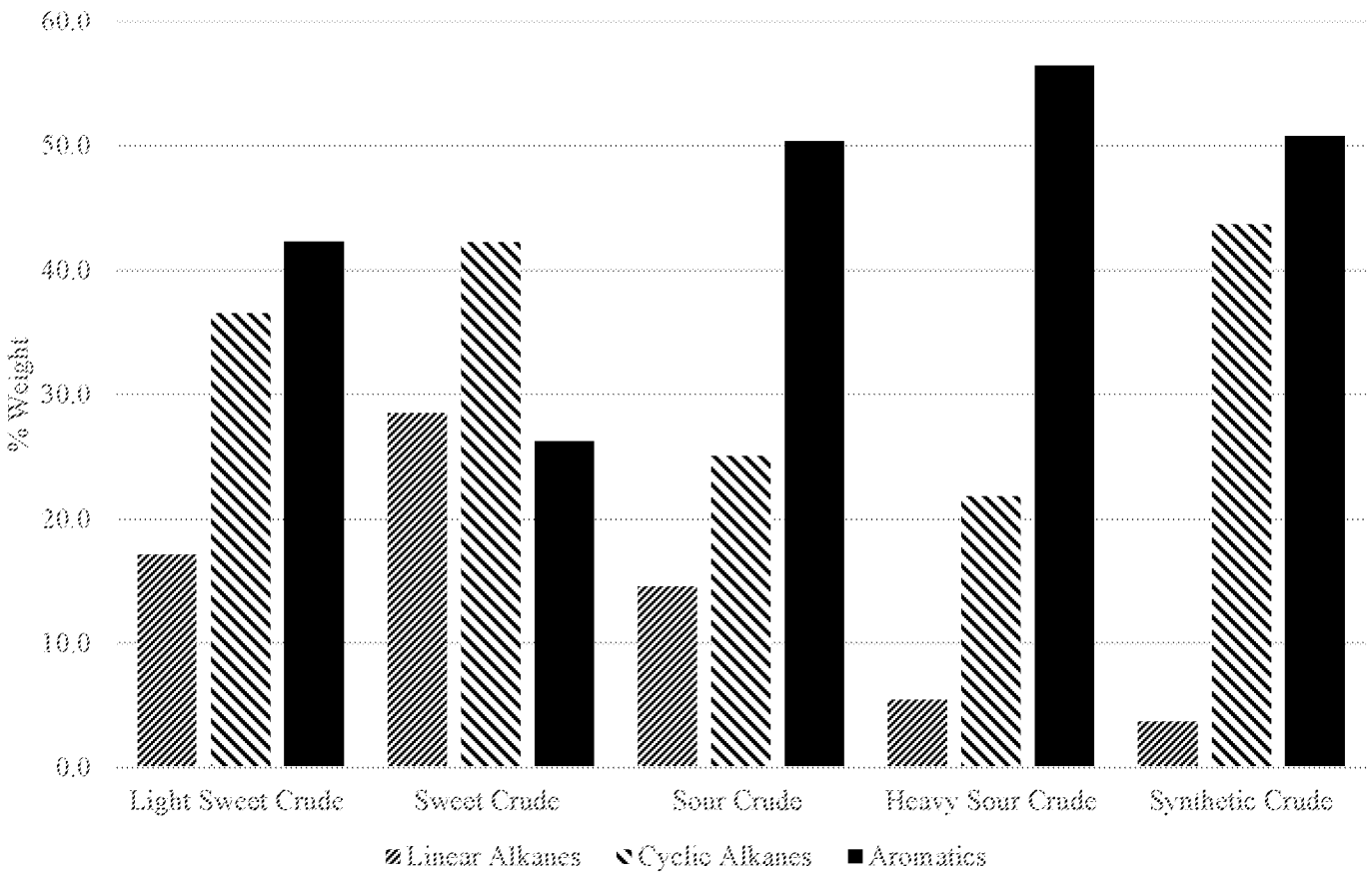
FIG. 4 provides additional modeled compositional information for resid boiling range fractions derived from the crude oils shown in FIG. 2.

FIG. 3 provides a graphic depiction of a portion of the compositional data shown in Table 2. For comparison, FIG. 4 provides additional modeled compositional data for resid fractions from the comparative crudes shown in FIG. 2. In FIG. 3, the resid derived from Condensate 1 shows a relatively high content of aromatics in comparison with the crudes in FIG. 4. In FIG. 3, the resid derived from Condensate 2 shows an unexpectedly high content of naphthenes and/or naphthenes relative to aromatics in comparison with the crudes shown in FIG. 4.

Table 4 provides additional composition information for condensate distillate fractions derived from the condensates shown in Table 1, as determined using 2-dimensional gas chromatography (2D-GC) according to UOP 990. In Table 4, the wt % of n-paraffins, isoparaffins, naphthenes, and aromatics is shown relative to the carbon number. Condensate 2 includes an unexpectedly high amount of isoparaffins, corresponding to more than 50 wt % of the Condensate 2 distillate fraction. Condensate 1 has roughly equal amounts of isoparaffins and naphthenes of ~30 wt %, while also including ~16 wt % of aromatics.

TABLE 4

| Compositional Analysis of Distillate Boiling Range Fractions | | | | | | | | |
|---|---|---|---|---|---|---|---|---|
| | Condensate #1 Composition, wt % | | | | Condensate #2 Composition, wt % | | | |
| C# | n-Paraffin | Iso-Paraffin | Naphthene | Aromatic | n-Paraffin | Iso-Paraffin | Naphthene | Aromatic |
| 7 | 0.00 | 0.00 | 0.00 | 0.01 | | | | |
| 8 | 0.01 | 0.00 | 0.01 | 0.05 | 0.00 | 0.00 | 0.00 | 0.02 |
| 9 | 0.33 | 0.12 | 0.33 | 0.80 | 0.42 | 0.16 | 0.17 | 0.77 |
| 10 | 2.17 | 1.70 | 2.25 | 1.53 | 3.10 | 3.63 | 2.05 | 1.03 |
| 11 | 2.75 | 3.61 | 3.84 | 1.56 | 3.39 | 8.74 | 3.18 | 0.92 |
| 12 | 2.73 | 3.01 | 5.06 | 2.58 | 3.14 | 8.34 | 3.54 | 0.85 |
| 13 | 2.38 | 3.51 | 4.74 | 1.45 | 2.49 | 6.53 | 3.41 | 0.54 |
| 14 | 2.20 | 3.42 | 3.31 | 1.71 | 2.10 | 5.24 | 2.43 | 0.50 |
| 15 | 2.17 | 3.08 | 2.88 | 1.73 | 1.88 | 4.86 | 1.40 | 0.42 |
| 16 | 2.05 | 2.70 | 1.91 | 1.65 | 1.56 | 4.25 | 0.83 | 0.41 |
| 17 | 1.88 | 2.46 | 1.88 | 1.76 | 1.16 | 3.76 | 0.58 | 0.37 |
| 18 | 1.39 | 2.88 | 1.29 | 0.54 | 0.87 | 3.29 | 0.38 | 0.13 |
| 19 | 1.48 | 2.05 | 1.54 | 0.41 | 0.87 | 2.34 | 0.55 | 0.09 |
| 20 | 0.43 | 1.23 | 0.71 | 0.12 | 0.27 | 1.46 | 0.13 | 0.01 |
| 21 | 0.11 | 0.47 | 0.36 | 0.03 | 0.08 | 0.58 | 0.19 | 0.00 |
| 22 | 0.02 | 0.10 | 0.03 | 0.00 | 0.00 | 0.03 | 0.00 | 0.00 |
| Total | 22.1 | 30.34 | 30.14 | 15.93 | 21.33 | 53.21 | 18.84 | 6.06 |

Table 5 shows additional characterization of the condensate distillate fractions. As shown in Table 5, the distillate fraction from Condensate 2 provides both a good cloud point and a high cetane index. Although the cloud point of the Condensate 1 distillate fraction is −1° C., the cetane value is still suitable for incorporation into typical distillate fuels. The sulfur content of the distillate boiling range condensate fractions is also low, even though the fractions have not been hydroprocessed and/or cracked. In some aspects, a distillate boiling range condensate fraction can have a sulfur content of 1000 wppm or less, or 700 wppm or less, or 500 wppm or less, or 200 wppm or less, such as down to 50 wppm or less or possibly still lower.

TABLE 5

| Properties of the Distillate Boiling Range Fractions | | | |
|---|---|---|---|
| | Property | | |
| | Unit | Condensate 1 | Condensate 2 |
| Density at 15.6° C. (D4052) | kg/m³ | 821 | 792 |
| Sulfur Content (D2622) | mg/kg | 500 | 110 |
| Kinematic Viscosity at 40° C. (D445) | cSt | 2.101 | 1.793 |
| Derived Cetane Number (D7668) | — | 48.6 | 56.0 |
| GC Distillation | | | |
| T10 | ° C. | 180 | 174 |
| T50 | ° C. | 247 | 229 |
| T90 | ° C. | 317 | 309 |
| Total Aromatics (SFC - D5186) | mass % | 21.8 | 13.9 |
| Polyaromatics | mass % | 6.2 | 2.3 |
| Cloud Point (D2500) | ° C. | −1 | −36 |
| Cetane Index, 4-variable | — | 52.0 | 59.0 |

Figure 5:
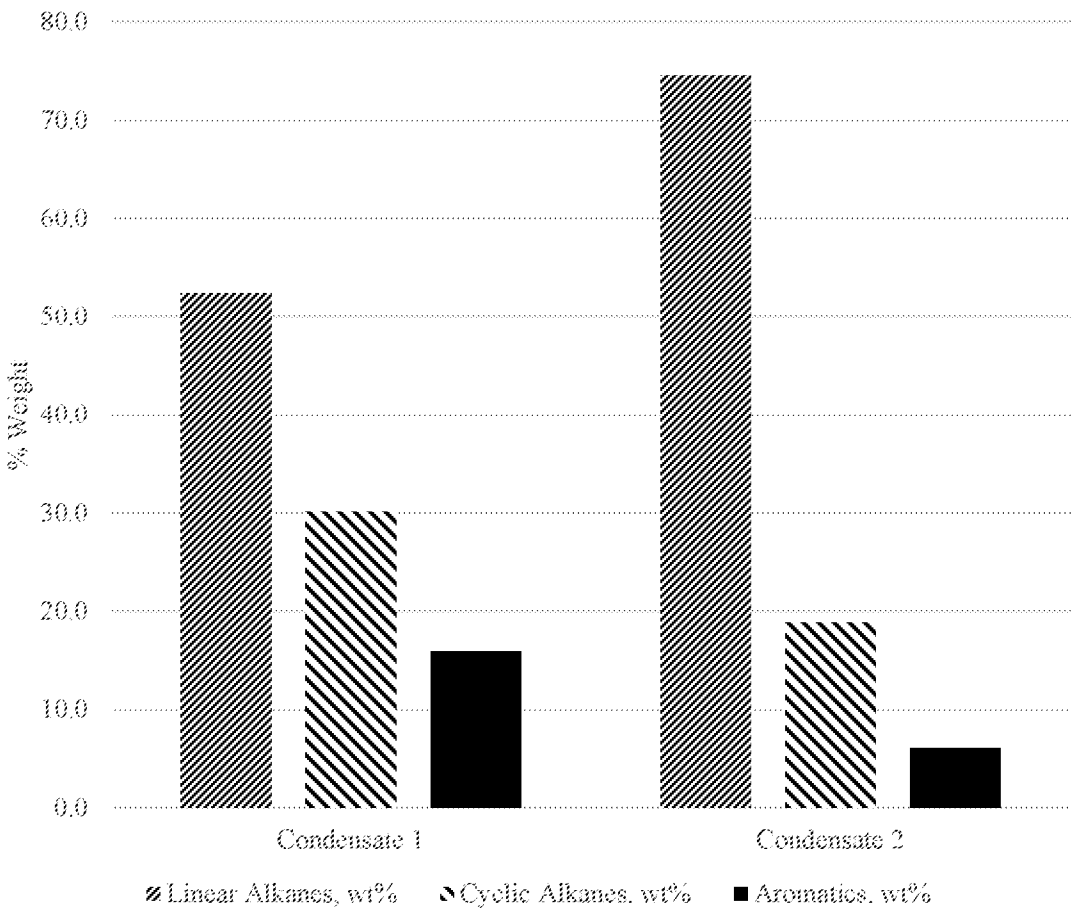
FIG. 5 provides additional compositional information for distillate boiling range fractions derived from the condensates shown in FIG. 1.
Figure 6:
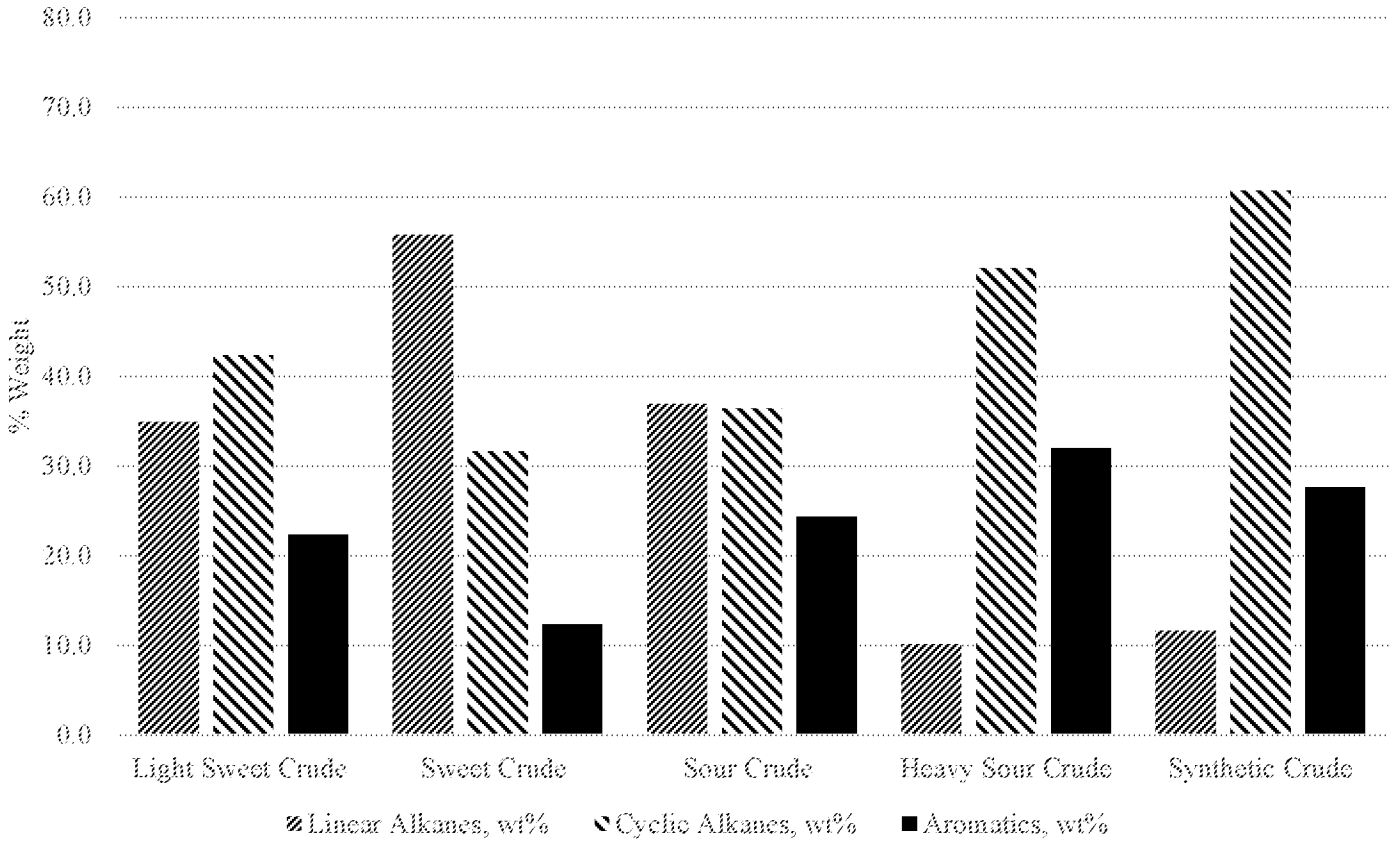
FIG. 6 provides additional modeled compositional information for distillate boiling range fractions derived from the crude oils shown in FIG. 2.

FIG. 5 provides a graphic depiction of a portion of the compositional data shown in Table 4. For comparison, FIG. 6 provides additional modeled compositional data for distillate fractions for the comparative crudes shown in FIG. 2.

In some aspects, it could also be beneficial to use the combined distillate boiling range and resid boiling range portions of a condensate as a fuel or fuel blending component. Table 6 provides properties for the combined distillate boiling range and resid boiling range portions of Condensate 1 and Condensate 2. As shown in Table 6, the combined distillate boiling range and resid boiling range fractions from the condensate can provide a fuel blending component with a high cetane index, a low pour point, and a reasonably low kinematic viscosity at 40° C.

TABLE 6

| Properties of the Combined Distillate and Resid Boiling Range Fractions | | | |
|---|---|---|---|
| | Test | | |
| | Unit | Condensate 1 | Condensate 2 |
| Density at 15.6° C. (D4052) | kg/m³ | 0.8659 | 0.8075 |
| Kinematic Viscosity at 40° C. (D445) | cSt | 12.86 | 3.027 |
| Pour Point (D97) | ° C. | −21 | −54 |

TABLE 6-continued

| Properties of the Combined Distillate and Resid Boiling Range Fractions | | | |
|---|---|---|---|
| | Test | | |
| | Unit | Condensate 1 | Condensate 2 |
| GC Distillation | | | |
| T10 | ° C. | 197 | 179 |
| T50 | ° C. | 351 | 262 |
| T90 | ° C. | 627 | 479 |
| Cetane Index, 4-variable | — | 66.8 | 68.1 |

Table 7 provides compositional analysis for jet boiling range fractions derived from Condensate 1 and Condensate 2, based on 2D-GC (UOP 990). As shown in Table 7, the Condensate 1 jet fraction has a somewhat elevated content of naphthenes, while the Condensate 2 jet fraction has a somewhat elevated content of isoparaffins.

TABLE 7

| Compositional Analysis of Jet Boiling Range Fractions | | | | | | | | |
|---|---|---|---|---|---|---|---|---|
| | Condensate #1 Jet | | | | Condensate #2 Jet | | | |
| C # | n-Paraffin | Iso-Paraffin | Naphthene | Aromatic | n-Paraffin | Iso-Paraffin | Naphthene | Aromatic |
| 6 | 0.00 | 0.00 | | 0.00 | 0.00 | 0.00 | | 0.00 |
| 7 | 0.00 | 0.00 | 0.00 | 0.02 | 0.00 | 0.00 | 0.00 | 0.01 |
| 8 | 0.18 | 0.07 | 0.17 | 0.36 | 0.34 | 0.14 | 0.10 | 0.58 |
| 9 | 2.75 | 1.44 | 2.25 | 2.20 | 4.16 | 3.89 | 1.82 | 2.11 |
| 10 | 3.49 | 5.84 | 5.74 | 2.14 | 4.45 | 10.29 | 4.57 | 1.17 |
| 11 | 3.60 | 5.59 | 4.87 | 2.03 | 3.97 | 9.04 | 3.24 | 0.90 |
| 12 | 3.36 | 4.20 | 6.24 | 2.15 | 3.14 | 7.42 | 3.49 | 0.77 |
| 13 | 2.99 | 3.67 | 6.85 | 1.71 | 2.34 | 7.22 | 2.31 | 0.53 |
| 14 | 2.69 | 3.49 | 4.80 | 1.38 | 1.99 | 6.02 | 1.51 | 0.38 |
| 15 | 1.81 | 3.40 | 2.91 | 0.41 | 1.42 | 4.18 | 1.33 | 0.13 |
| 16 | 0.37 | 1.14 | 1.23 | 0.15 | 0.56 | 2.32 | 0.69 | 0.07 |
| 17 | 0.02 | 0.15 | 0.14 | 0.01 | 0.03 | 0.60 | 0.12 | 0.01 |
| 18 | 0.00 | 0.01 | 0.00 | 0.00 | 0.00 | 0.01 | 0.00 | 0.00 |

Table 8 provides additional details regarding the properties of the condensate jet boiling range fractions. As shown in Table 8, the jet condensate fractions generally have properties that are consistent with the requirements for a commercial jet fuel, such as according to ASTM D1655.

TABLE 8

| Properties of the Jet Boiling Range Fractions | | | |
|---|---|---|---|
| | Property | | |
| | Unit | Condensate 1 | Condensate 2 |
| Density at 15.6° C. (D4052) | kg/m³ | 802 | 777 |
| Copper Strip Corrosion | — | 1A | 1A |
| Sulfur Content (D2622) | mass % | 0.0240 | 0.0069 |
| Kinematic Viscosity at −20° C. (D445) | cSt | 4.796 | 3.995 |
| Smoke Point (D1322) | mm | 26.4 | 37.6 |
| GC Distillation | | | |
| T10 | ° C. | 158 | 151 |
| T50 | ° C. | 211 | 197 |
| T90 | ° C. | 262 | 259 |
| Derived Cetane Number (D7668) | — | 48.3 | 52.1 |
| Freeze Point (D2386) | ° C. | −25.3 | −54.3 |

Based in part on the properties in Table 8, the jet fractions were further characterized for potential suitability for use as a jet fuel based on JFTOT™ thermal stability testing. Table 9 shows the results from the thermal stability testing both before and after clay treating of the condensate jet fractions. Prior to clay treating, the condensate jet fractions did not pass the JFTOT™ thermal stability test at a temperature of 260° C. After clay treating, both condensate fractions satisfied the thermal stability test.

TABLE 9

JFTOT Thermal Stability of the Jet Boiling Range Fractions

| | Visual JFTOT Tube Rating | | Ellipsometric JFTOT Tube Rating (maximum deposit thickness, nm) | |
|---|---|---|---|---|
| | Condensate 1 | Condensate 2 | Condensate 1 | Condensate 2 |
| JFTOT Result at 260 C., Untreated | >4P | >4P | 115 | 130 |
| JFTOT Result at 260 C., After Clay Treatment | <2 | 2 | 15 | 15 |

Table 10 shows compositional data for naphtha fractions based on Condensate 1 and Condensate 2 based on Detailed Hydrocarbon Analysis as specified in ASTM D6730.

TABLE 10

Compositional Analysis of Gasoline Boiling Range Fractions

| | Condensate #1 Gasoline | | | | Condensate #2 Gasoline | | | |
|---|---|---|---|---|---|---|---|---|
| C # | n-Paraffin | Iso-Paraffin | Naphthene | Aromatic | n-Paraffin | Iso-Paraffin | Naphthene | Aromatic |
| 4 | 0.23 | 0.01 | | | 0.01 | | | |
| 5 | 3.98 | 1.06 | 0.65 | | 4.81 | 1.18 | 0.22 | |
| 6 | 7.25 | 4.83 | 5.00 | 0.44 | 9.60 | 6.20 | 3.19 | 0.40 |
| 7 | 6.78 | 5.70 | 8.99 | 1.16 | 8.40 | 8.56 | 5.02 | 1.20 |
| 8 | 4.54 | 5.57 | 7.42 | 1.45 | 5.39 | 7.65 | 4.07 | 1.73 |
| 9 | 3.52 | 4.39 | 6.28 | 2.27 | 3.76 | 6.83 | 3.30 | 1.52 |
| 10 | 2.54 | 4.57 | 4.20 | 0.64 | 2.31 | 5.76 | 2.33 | 0.25 |
| 11 | 0.92 | 2.37 | 1.89 | 0.11 | 0.95 | 3.36 | 1.34 | |

Table 11 shows additional properties of the condensate naphtha fractions.

TABLE 11

Properties of the Gasoline Boiling Range Fractions

| | | Test | |
|---|---|---|---|
| | Unit | Condensate 1 | Condensate 2 |
| Density at 15.6° C. (D4052) | kg/m$^3$ | 732 | 718 |
| Sulfur Content (D2622) | mg/kg | 60 | 17 |
| RON (D2699) | — | 46 | 40 |
| MON (D2700) | — | 47 | 42 |
| R + M/2 | — | 46.5 | 41 |
| GC Distillation | | | |
| T10 | ° C. | 68 | 62 |
| T50 | ° C. | 117 | 116.5 |
| T90 | ° C. | 173 | 173 |
| Vapor Pressure (D323) | psi | 3.41 | 3.51 |

Blending Components for Forming Fuel Fractions

In the examples below, a variety of refinery fractions and finished fuels are used as representative blending components for the formation of fuel blends. As noted above, the finished fuels can also be viewed as being representative of hydroprocessed distillate and/or resid boiling range fractions.

Some of the representative blending components correspond to commercially available fuel oils. The commercially available residual fuel oils correspond to either RMG180 or RMG380 grade residual fuel oils. Such commercially available residual fuel oils typically include a substantial portion of hydrotreated vacuum resid. The hydrotreated distillate bottoms fraction noted above was also used for some blends. Due to the highly paraffinic nature of the hydrotreated distillate bottoms fraction, it would be expected for such a fraction to have compatibility issues with traditional residual fuel oils. For some marine distillate blends, a portion of a commercial marine gas oil was used as a blend component. The commercial marine gas oil is believed to be representative of a type of hydrotreated distillate fraction.

Another representative blending component corresponded to a refinery fraction. The refinery fraction was a cracked gas oil fraction corresponding to a light cycle oil from a FCC process. Still another blending component corresponded to a hydrotreated vegetable oil. Yet another representative blending component was an ultra-low sulfur diesel fuel (i.e., a hydrotreated distillate fuel).

Condensate Fractions for Formation of Fuel Products

A first set of potential fuel oil blends was formed using the condensate resid fraction from Condensate 1. Table 12 shows the blend ratios (vol %) used for forming fuel oil blends involving Condensate 1. Blend 1 corresponds to a blend of 5 wt % of a commercially available RMG 380 fuel oil (referred to in Table 12 as RMG 380 A) and the condensate resid fraction from Condensate 1. Blend 2 corresponds to a blend of the condensate resid fraction from Condensate 1 and a cracked gas oil. Blend 3 corresponds to a blend of the condensate resid fraction from Condensate 1 and a commercially available RMG 180 fuel oil. Blend 4 corresponds to a blend of the condensate resid fraction from Condensate 1, an ultra-low sulfur diesel fuel, and a commercially available RMG180 fuel oil.

TABLE 12

Blends for Marine Fuel Oil (Condensate 1 Resid Fractions)

| | <Values in vol %> | | | | |
|---|---|---|---|---|---|
| | Condensate 1 (resid) | Commercial Diesel (ULSD) | RMG 180 | RMG 380 (A) | Cracked Gas Oil |
| Blend 1 | 95 | | | 5 | |
| Blend 2 | 65 | | | | 35 |

TABLE 12-continued

| Blends for Marine Fuel Oil (Condensate 1 Resid Fractions) | | | | | |
|---|---|---|---|---|---|
| | <Values in vol %> | | | | |
| | Condensate 1 (resid) | Commercial Diesel (ULSD) | RMG 180 | RMG 380 (A) | Cracked Gas Oil |
| Blend 3 | 40 | | 60 | | |
| Blend 4 | 17 | 58 | 25 | | |

Blends 1 and 3 in Table 12 correspond to blends of condensate and commercially hydroprocessed resid. As shown in Table 13, Blend 3 shows the condensate can have good compatibility with lower viscosity commercial residual fuel oils. Based on Table 13, Blend 1 shows that a limited amount of higher viscosity commercial residual fuel oil can be successfully combined with a condensate resid fraction, although the amount of sediment was higher than the amount of sediment in either the condensate resid fraction or the RMG 380. Both Blends 1 and 3 have pour points below the required value of 30° C. as well as CCAI values below 800, indicating good ignition quality. Based on the sulfur content, Blends 1 and 3 could qualify or nearly qualify as low sulfur fuel oils (less than 0.5 wt % sulfur.) Blend 2 corresponds to a potential low sulfur fuel oil with a low pour point of −18° C. Thus, Blend 2 could be suitable for blending with other potential components to improve the overall pour point of a fuel oil. Blend 4 corresponds to a potential ultra low sulfur fuel oil or blend component with a pour point of −21° C. Both Blends 2 and 4 also have a desirable combination of CCAI and pour point values. Overall, the blends in Tables 12 and 13 show that condensate resid fractions can be suitable for incorporation into a variety of marine residual fuel oils.

TABLE 13

| Properties of Blends 1-4 | | | | |
|---|---|---|---|---|
| | Blend 1 | Blend 2 | Blend 3 | Blend 4 |
| Density (kg/m$^3$) (D4052) | 889 | 900 | 912 | 859 |
| Sulfur (wppm) (D2622) | 5230 | 4910 | 2200 | 1020 |
| KV @ 50° C. (cSt) (D445) | 168 | 21.0 | 404 | 8.7 |
| Pour Point (° C.) (D97) | 18 | −15 | 18 | −21 |
| Total Sediment (wt %) | 0.06 | 0.01 | <0.01 | <0.01 |
| CCAI | 759 | 801 | 772 | 780 |

A second set of potential fuel oil blends was formed using the condensate resid fraction from Condensate 2. Table 14 shows the blend ratios (vol %) used for forming fuel oil blends involving Condensate 2. Blends 5 and 7 correspond to various ratios of Condensate 2 with two different commercially available RMG380 grade residual fuel oils. Blend 6 corresponds to a blend of Condensate 2 with ultra low sulfur diesel and 10 vol % of a commercially available RMG180 residual fuel oil. Blend 8 correspond to a blend of the condensate resid fractions from Condensate 1 and Condensate 2.

TABLE 14

| Blends for Marine Fuel Oil (Condensate 2 Resid Fractions) | | | | | | |
|---|---|---|---|---|---|---|
| | <Values in vol %> | | | | | |
| | Condensate 1 (resid) | Condensate 2 (resid) | Commercial Diesel (ULSD) | RMG 180 | RMG 380 (A) | RMG 380 (B) |
| Blend 5 | | 70 | | | | 30 |
| Blend 6 | | 45 | 45 | 10 | | |
| Blend 7 | | 40 | | | 8 | 52 |
| Blend 8 | 6 | 94 | | | | |

In contrast to Blends 1 to 4, Table 15 shows that none of Blends 5 to 8 correspond to conventional residual fuel oils or fuel oil blends. For example, Blends 5 and 7 demonstrate some compatibility limitations between condensate resid fractions and commercially available fuel oils. Both Blend 5 and Blend 7 have a total sediment level that is higher than the ISO 8217 specification for a fuel oil. Because this sediment amount is greater than the amount of sediment in the individual blend components, this indicates development of additional sediment after blending due to incompatibility. It is noted that Blend 5 only includes 30 vol % of a RMG380 fuel oil as part of the blend. This indicates that the ability to use a residual fuel oil from a natural gas condensate resid fraction is not simply an inherent property of the condensate.

Blend 6 in Table 15 is also not a conventional residual fuel oil. However, that is because Blend 6 corresponds to a marine gas oil, such as a DMB grade marine gas oil. It is unexpected that the natural gas condensate resid fraction could be used in combination with 10 wt % of a residual fuel oil to form a marine gas oil. This also demonstrates that use of natural gas condensate fractions can reduce or minimize the need to use hydrotreated distillate fractions as blend components when attempting to improve the grade of marine fuel oils. With regard to Blend 8, this demonstrates the ability to use a blend of natural gas condensate resid fractions to form a residual fuel oil. It is noted that no commercial residual fuel oil is included as part of Blend 8.

TABLE 15

| Properties of Blends 5-8 | | | | |
|---|---|---|---|---|
| | Blend 5 | Blend 6 | Blend 7 | Blend 8 |
| Density (kg/m$^3$) (D4052) | 854 | 836 | 884 | 831 |
| Sulfur (wppm) (D2622) | 1520 | 530 | 3350 | 846 |
| KV @ 50° C. (cSt) (D445) | 49 | 7.1 | 110 | 24 |
| Pour Point (° C.) (D97) | −18 | −21 | −6 | 3 |
| Total Sediment (wt %) | 0.21 | <0.01 | 0.39 | <0.01 |
| CCAI | 741 | 761 | 759 | 730 |

In addition to condensate resid fractions, condensate distillate fractions can also be used for formation of marine fuel oils. Table 16 shows blend ratios for a third group of fuel oil blends. Blends 9 and 10 correspond to blends of a commercially available RMG380 fuel oil with 20 vol % or less of a condensate distillate fraction. Blends 11 and 12 correspond to blends of condensate distillate fraction(s) with ultra-low sulfur fuel oils and residual fuel oils.

TABLE 16

| Blends for Marine Fuel Oil (Condensate Distillate Fractions) | | | | | |
|---|---|---|---|---|---|
| | <Values in vol %> | | | | |
| | Condensate 1 (distillate) | Condensate 2 (distillate) | HDT Distillate Bottoms | RMG 180 | RMG 380 (A) |
| Blend 9 | 20 | | | | 80 |
| Blend 10 | | 7 | | | 93 |
| Blend 11 | | 35 | 15 | 50 | |
| Blend 12 | 20 | | 60 | 7 | 13 |

Table 17 shows the properties of the resulting fuel oil blends. Blend 9 shows that a condensate distillate fraction can be used to modify a higher viscosity fuel oil, such as RMG380, by reducing the viscosity to a lower value so that the fuel oil can qualify, for example, as RMD80. It is noted that the compatibility problems observed in Blends 5 and 7 were not observed in Blend 9. An additional unexpected benefit of Blend 9 is the dramatic reduction in pour point. The pour point of a typical commercial RMG380 fuel oil is typically 0° C.-15° C. Based on addition of 20 vol % of a condensate distillate fraction, the pour point of the entire fuel oil blend was reduced to −18° C. This is a dramatic and unexpected improvement in pour point. Blend 10 shows that the unexpected benefit can be achieved using still smaller quantities of condensate distillate fraction in a fuel oil blend. As shown in Table 17, Blend 10 has a pour point of −6° C., even though Blend 10 is composed of 93 vol % of a commercial RMG380 fuel oil, which has a typical pour point range of 0° C. to 15° C. Thus, even as little as roughly 5 wt % of a natural gas condensate distillate fraction can provide a dramatic improvement in pour point for a fuel oil fraction. It is noted that the small amount of natural gas condensate distillate fraction also reduced the viscosity of the resulting fuel oil. While the kinematic viscosity at 50° C. of Blend 10 is too high to qualify for use as RMG180, Blend 10 demonstrates that addition of slightly more of the condensate resid fraction from Condensate 2 would produce a sufficient reduction in viscosity to qualify as RMG180.

Blend 11 corresponds 35 vol % of a condensate distillate fraction, 15 wt % of a hydrotreated distillate bottoms fraction, and 50 wt % of a commercially available residual fuel oil (RMG180). The hydrotreated bottoms fraction corresponded to a heavy viscous product that was potentially suitable for use as a fuel oil blendstock, optionally after pour point adjustment. The hydrotreated bottoms fraction was relatively paraffinic in nature. Based on incorporation of the condensate distillate fraction, a blend including 50 wt % of residual fuel oil has a sufficiently low sulfur content to qualify as an ultra-low sulfur fuel oil. Similar to Blends 9 and 10, inclusion of the condensate distillate fraction is also beneficial for reducing the pour point of Blend 11. Blend 12 further shows how a condensate distillate fraction can be used to facilitate making a low sulfur fuel oil (less than 0.5 wt % sulfur) in a blend that includes 20 wt % of residual fuel oils.

TABLE 17

| Properties of Blends 9-12 | | | | |
|---|---|---|---|---|
| | Blend 9 | Blend 10 | Blend 11 | Blend 12 |
| Density (kg/m$^3$) (D4052) | 927 | 948 | 857 | 874 |
| Sulfur (wppm) (D2622) | 25900 | 28900 | 946 | 4580 |

TABLE 17-continued

| Properties of Blends 9-12 | | | | |
|---|---|---|---|---|
| | Blend 9 | Blend 10 | Blend 11 | Blend 12 |
| KV @ 50° C. (cSt) (D445) | 70 | 195 | 16 | 23 |
| Pour Point (° C.) (D97) | −18 | −6 | −24 | −9 |
| Total Sediment (wt %) | <0.01 | <0.01 | <0.01 | <0.01 |
| CCAI | 808 | 816 | 763 | 773 |

Table 18 shows the components in a final set of blends that were formed using condensate distillate fractions. The goal of the blends in Table 18 was to create blends corresponding to marine distillate fuels (marine gas oil), as opposed to the fuel oils shown in Tables 12-17.

TABLE 18

| Blends for Marine Gas Oil (Condensate Distillate Fractions) | | | | | |
|---|---|---|---|---|---|
| | <Values in vol %> | | | | |
| | Condensate 1 (distillate) | Condensate 2 (distillate) | Marine Gas Oil | Cracked Gas Oil | Hydrotreated Vegetable Oil |
| Blend 13 | 17 | | 83 | | |
| Blend 14 | | 90 | | 10 | |
| Blend 15 | 40 | 20 | 30 | | 10 |
| Blend 16 | | 45 | | 55 | |

Table 19 shows the corresponding characterization of Blends 13-16. Blend 13 shows that a condensate distillate fraction can be blended with a commercially available marine gas oil to form a blend that remains qualified for use as DMA. Blend 14 shows that a marine gas oil can be formed by blending condensate distillate fraction with a cracked gas oil. Blend 15 combines natural gas condensate and hydrotreated vegetable oil with marine gas oil to form a marine gas oil blend. Each of Blends 13 to 15 provides a high cetane index of greater than 50, which could make any of Blends 13 to 15 suitable as a blending component with a lower cetane index fuel. Alternatively, each of Blends 13 to 15 can be suitable as a marine gas oil, such as DMA. Blend 16 has a lower cetane index of 35, which is suitable for use as DMB marine gas oil. A comparison of Blends 14 and 16 demonstrates that a condensate distillate fraction can be suitable for forming suitable marine gas oils that also incorporate a disadvantaged feed, such as cracked gas oil.

TABLE 19

| Properties of Blends 13-16 | | | | |
|---|---|---|---|---|
| | Blend 13 | Blend 14 | Blend 15 | Blend 16 |
| Density (kg/m$^3$) (D4052) | 861 | 810 | 826 | 885 |
| Sulfur (wppm) (D2622) | 88 | 1050 | 230 | 4720 |
| KV @ 40° C. (cSt) (D445) | 5.3 | 1.9 | 2.9 | 2.3 |
| Initial Boiling Point (° C.) | 204 | 185 | 190 | 186 |
| T10 | 239 | 197 | 208 | 207 |
| T50 | 319 | 232 | 272 | 256 |
| T90 | 371 | 296 | 342 | 333 |
| Final Boiling Point | 392 | 336 | 379 | 371 |
| Derived Cetane Index | 51.9 | 53.9 | 57.0 | 35.0 |

ADDITIONAL EMBODIMENTS-RESIDUAL FUELS

Embodiment 1

A residual fuel or fuel blending product, comprising 5 vol % to 60 vol % (or 5 vol % to 50 vol %) of a natural gas condensate distillate fraction and 40 vol % or more (or 50 vol % or more) of a (optionally hydroprocessed) resid boiling range fraction, the residual fuel or fuel blending product comprising a density at 15° C. of 960 kg/m$^3$ or less, a sulfur content of 30,000 wppm or less, a pour point of 0° C. or less, and a CCAI of 825 or less (or 800 or less), the natural gas condensate distillate fraction comprising a density at 15° C. of 835 kg/m$^3$ or less (or 825 kg/m$^3$ or less, or 805 kg/m$^3$ or less).

Embodiment 2

A method for forming a residual fuel or fuel blending product, comprising blending 5 vol % to 60 vol % (or 5 vol % to 50 vol %) of a natural gas condensate distillate fraction with 40 vol % or more (or 50 vol % or more) of a (optionally hydroprocessed) resid boiling range fraction, the residual fuel or fuel blending product comprising a density at 15° C. of 960 kg/m$^3$ or less, a sulfur content of 30,000 wppm or less, a pour point of 0° C. or less, and a CCAI of 825 or less (or 800 or less), the natural gas condensate distillate fraction comprising a density at 15° C. of 835 kg/m$^3$ or less (or 825 kg/m$^3$ or less, or 805 kg/m$^3$ or less).

Embodiment 3

The residual fuel or fuel blending product of Embodiment 1 or method of Embodiment 2, wherein the residual fuel or fuel blending product comprises a pour point of −5° C. or less, or −10° C. or less, or −15° C. or less; or wherein the residual fuel or fuel blending product comprises a density at 15° C. of 900 kg/m$^3$ or less, or 875 kg/m$^3$ or less, or 860 kg/m$^3$ or less; or a combination thereof.

Embodiment 4

The residual fuel or fuel blending product or method of any of the above embodiments, wherein the residual fuel or fuel blending product comprises 5 vol % to 15 vol % of the natural gas condensate distillate fraction.

Embodiment 5

The residual fuel or fuel blending product or method of any of the above embodiments, a) wherein the natural gas condensate distillate fraction comprises a non-hydroprocessed fraction, a non-cracked fraction, or a combination thereof; b) wherein the natural gas condensate distillate fraction comprises a sulfur content of 1000 wppm or less, or 700 wppm or less, or 500 wppm or less; or c) a combination of a) and b).

Embodiment 6

A residual fuel or fuel blending product, comprising 5 vol % to 95 vol % (or 15 vol % to 85 vol %) of a natural gas condensate resid fraction and 5 vol % or more of a (optionally hydroprocessed) distillate fraction, a (optionally hydroprocessed) resid boiling range fraction, a cracked distillate fraction, or a combination thereof, the residual fuel or fuel blending product comprising a density at 15° C. of 920 kg/m$^3$ or less, a sulfur content of 10,000 wppm or less, a pour point of 24° C. or less (or 0° C. or less, or −5° C. or less, or −10° C. or less), and a CCAI of 825 or less (or 800 or less), the natural gas condensate resid fraction comprising a density at 15° C. of 925 kg/m$^3$ or less (or 875 kg/m$^3$ or less).

Embodiment 7

A method for forming a residual fuel or fuel blending product, comprising blending 5 vol % to 95 vol % (or 15 vol % to 85 vol %) of a natural gas condensate resid fraction with 5 vol % or more (or 10 vol % or more) of a (optionally hydroprocessed) distillate fraction, a (optionally hydroprocessed) resid boiling range fraction, a cracked distillate fraction, or a combination thereof, the residual fuel or fuel blending product comprising a density at 15° C. of 920 kg/m$^3$ or less, a sulfur content of 10,000 wppm or less, a pour point of 24° C. or less (or 0° C. or less, or −5° C. or less, or −10° C. or less), and a CCAI of 825 or less (or 800 or less), the natural gas condensate resid fraction comprising a density at 15° C. of 925 kg/m$^3$ or less (or 875 kg/m$^3$ or less).

Embodiment 8

The residual fuel or fuel blending product of Embodiment 6 or the method of Embodiment 7, wherein the residual fuel or fuel blending product comprises 10 vol % or more of a hydroprocessed resid boiling range fraction comprising a kinematic viscosity at 50° C. of 200 cSt or less (or 180 cSt or less).

Embodiment 9

The residual fuel or fuel blending product or method of any of Embodiments 6-8, wherein the residual fuel or fuel blending product comprises a kinematic viscosity at 50° C. of 200 cSt or less (or 180 cSt or less); or wherein the residual fuel or fuel blending product comprises a kinematic viscosity at 50° C. of 25 cSt or less (or 20 cSt or less, or 10 cSt or less).

Embodiment 10

The residual fuel or fuel blending product or method of any of Embodiments 6-9, wherein the residual fuel or fuel blending product comprises a weight ratio of carbon atoms to hydrogen atoms of 7.3 or less, or 7.0 or less; or wherein the natural gas condensate resid fraction comprises a weight ratio of carbon atoms to hydrogen atoms of 7.0 or less, or 6.8 or less; or a combination thereof.

Embodiment 11

The residual fuel or fuel blending product or method of any of Embodiments 6-10, a) wherein the natural gas condensate resid fraction comprises a non-hydroprocessed fraction, a non-cracked fraction, or a combination thereof; b) wherein the natural gas condensate resid fraction comprises a sulfur content of 5000 wppm or less, or 1000 wppm or less, or 700 wppm or less; or c) a combination of a) and b).

Embodiment 12

The residual fuel or fuel blending product or method of any of Embodiments 6-11, wherein the residual fuel or fuel blending product comprises 5 vol % to 65 vol % of a hydroprocessed resid boiling range fraction and optionally 10 vol % or less of a cracked distillate boiling range fraction; or wherein the residual fuel or fuel blending product comprises 10 vol % or less of a hydroprocessed distillate fraction; or a combination thereof.

Embodiment 13

The residual fuel or fuel blending product or method of any of Embodiments 6-12, wherein the residual fuel or fuel blending product comprises 15 vol % to 50 vol % of a cracked distillate boiling range fraction and optionally 10 vol % or less of a hydroprocessed resid boiling range fraction.

Embodiment 14

The residual fuel or fuel blending product or method of any of Embodiments 6-13, wherein the natural gas condensate distillate fraction comprises 70 vol % or more of saturates, or 80 vol % or more, or wherein the natural gas condensate distillate fraction comprises 30 vol % or more or aromatics, or 35 vol % or more.

Additional Embodiments—Distillate Fuels

Embodiment 15

A marine distillate fuel or fuel blending product, comprising 5 vol % to 70 vol % (or 10 vol % to 60 vol %, or 20 vol % to 60 vol %) of a natural gas condensate resid fraction, and 5 vol % to 70 vol % (or 10 vol % to 60 vol %, or 20 vol % to 60 vol %) of a distillate fraction, the marine distillate fuel or fuel blending product comprising a density at 15° C. of 860 kg/m$^3$ or less (or 850 kg/m$^3$ or less, or 840 kg/m$^3$ or less), a sulfur content of 5000 wppm or less, a pour point of 0° C. or less (or −5° C. or less, or −10° C. or less), and a cetane index of 35 or more, the natural gas condensate resid fraction comprising a density at 15° C. of 925 kg/m$^3$ or less (or 875 kg/m$^3$ or less).

Embodiment 16

A method for forming a marine distillate fuel or fuel blending product, comprising blending 5 vol % to 70 vol % (or 10 vol % to 60 vol %, or 20 vol % to 60 vol %) of a natural gas condensate resid fraction with 5 vol % to 70 vol % (or 10 vol % to 60 vol %, or 20 vol % to 60 vol %) of a distillate fraction, the marine distillate fuel or fuel blending product comprising a density at 15° C. of 860 kg/m$^3$ or less (or 850 kg/m$^3$ or less, or 840 kg/m$^3$ or less), a sulfur content of 5000 wppm or less, a pour point of 0° C. or less (or −5° C. or less, or −10° C. or less), and a cetane index of 35 or more, the natural gas condensate resid fraction comprising a density at 15° C. of 925 kg/m$^3$ or less (or 875 kg/m$^3$ or less).

Embodiment 17

The marine distillate fuel or fuel blending product or method of any of Embodiments 15-16, wherein the natural gas condensate resid fraction comprises 70 vol % or more of saturates, or 80 vol % or more; or wherein the marine distillate fuel or fuel blending product comprises a cetane index of 35 or more (or 40 or more); or a combination thereof.

Embodiment 18

The marine distillate fuel or fuel blending product or method of any of Embodiments 15-17, wherein the marine distillate fuel or fuel blending product comprises a kinematic viscosity at 50° C. of 12 cSt or less (or 10 cSt or less, or 8 cSt or less).

Embodiment 19

The marine distillate fuel or fuel blending product or method of any of Embodiments 15-17, wherein the marine distillate fuel or fuel blending product further comprises 8 vol % or more of a hydroprocessed resid boiling range fraction (or 10 vol % or more, or 12 vol % or more, or 15 vol % or more), the hydroprocessed resid boiling range fraction optionally comprising a kinematic viscosity at 50° C. of 200 cSt or less (or 180 cSt or less).

Embodiment 20

The marine distillate fuel or fuel blending product or method of any of Embodiments 15-19, wherein the marine distillate fuel or fuel blending product comprises a sulfur content of 1000 wppm or more, or wherein the marine distillate fuel or fuel blending product comprises a sulfur content of 2000 wppm or less.

Embodiment 21

The marine distillate fuel or fuel blending product or method of any of Embodiments 15-20, wherein the distillate fraction comprises a hydroprocessed distillate fraction.

Embodiment 22

The marine distillate fuel or fuel blending product or method of any of Embodiments 15-21, a) wherein the natural gas condensate resid fraction comprises a non-hydroprocessed fraction, a non-cracked fraction, or a combination thereof; b) wherein the natural gas condensate resid fraction comprises a sulfur content of 1000 wppm or less, or 700 wppm or less; or c) a combination of a) and b).

Embodiment 23

A distillate boiling range composition, comprising 5 vol % to 95 to vol % (or 15 vol % to 85 vol %) of a natural gas condensate distillate fraction and 5 vol % or more (or 10 vol % or more) of a (optionally hydroprocessed) distillate fraction, a cracked distillate fraction, or a combination thereof, the distillate boiling range composition comprising a density at 15° C. of 900 kg/m$^3$ or less, a sulfur content of 10,000 wppm or less, and a cetane index of 35.0 or more, the natural gas condensate distillate fraction comprising a density at 15° C. of 835 kg/m$^3$ or less (or 825 kg/m$^3$ or less, or 805 kg/m$^3$ or less).

Embodiment 24

A method for forming a distillate boiling range composition, comprising blending 5 vol % to 95 vol % (or 15 vol % to 85 vol %) of a natural gas condensate distillate fraction with 5 vol % or more (or 10 vol % or more) of a (optionally hydroprocessed) distillate fraction, a cracked distillate fraction, or a combination thereof, the distillate boiling range composition comprising a density at 15° C. of 900 kg/m$^3$ or less, a sulfur content of 10,000 wppm or less, and a cetane index of 35.0 or more, the natural gas condensate distillate fraction comprising a density at 15° C. of 835 kg/m$^3$ or less (or 825 kg/m$^3$ or less, or 805 kg/m$^3$ or less).

Embodiment 25

The distillate boiling range composition or method of any of Embodiments 23-24, wherein the distillate boiling range composition comprises a density at 15° C. of 850 kg/m$^3$ or less, or 835 kg/m$^3$ or less, or 820 kg/m$^3$ or less.

Embodiment 26

The distillate boiling range composition or method of any of Embodiments 23-25, wherein the distillate boiling range composition further comprises 10 vol % or more of a hydroprocessed distillate boiling range biocomponent fraction; or wherein the distillate boiling range composition comprises 15 vol % to 85 vol % of a hydroprocessed distillate fraction and optionally 10 vol % or less of a cracked distillate boiling range fraction; or a combination thereof.

Embodiment 27

The distillate boiling range composition or method of any of Embodiments 23-26, wherein the distillate boiling range composition comprises 15 vol % to 65 vol % of a cracked distillate boiling range fraction and optionally 10 vol % or less of a hydroprocessed distillate fraction.

Embodiment 28

The distillate boiling range composition or method of any of Embodiments 23-27, wherein the distillate boiling range composition comprises a cetane index of 40.0 or more, or 45.0 or more, or 50.0 or more.

Embodiment 29

The distillate boiling range composition or method of any of Embodiments 23-28, a) wherein the natural gas condensate distillate fraction comprises a non-hydroprocessed fraction, a non-cracked fraction, or a combination thereof; b) wherein the natural gas condensate distillate fraction comprises a sulfur content of 700 wppm or less, or 500 wppm or less, or 200 wppm or less; or c) a combination of a) and b).

Additional Embodiments—Other Products

Embodiment 30

A jet fuel or fuel blending product, comprising a clay treated natural gas condensate fraction having a T10 distillation point of 150° C. to 170° C. and a T90 distillation point of 270° C. or less.

Embodiment 31

A method for forming a jet fuel or fuel blending product, comprising: clay treating a natural gas condensate fraction having a T10 distillation point of 150° C. to 170° C. and a T90 distillation point of 270° C. or less.

Embodiment 32

The jet fuel or fuel blending product or method of any of Embodiments 30-31, wherein the clay treated natural gas condensate fraction comprises a derived cetane number of 45 or more, or 48 or more; or wherein the clay treated natural gas condensate fraction comprises a freeze point of −20° C. or less, or −25° C. or less, or −40° C. or less; or a combination thereof.

Embodiment 33

The jet fuel or fuel blending product or method of any of Embodiments 30-32, wherein the clay treated natural gas condensate fraction comprises a smoke point of 20.0 mm or more, or 25.0 mm or more; or wherein the clay treated natural gas condensate fraction comprises a kinematic viscosity at −20° C. of 3.5 cSt to 5.5 cSt; or a combination thereof.

Embodiment 34

The jet fuel or fuel blending product or method of any of Embodiments 30-33, wherein the clay treated natural gas condensate fraction comprises 40 wt % or more of isoparaffins, or 45 wt % or more, or 50 wt % or more; or wherein the clay treated natural gas condensate fraction comprises 10 wt % or less of aromatics, or 8 wt % or less, or 6 wt % or less; or a combination thereof.

Embodiment 35

The jet fuel or fuel blending product or method of any of Embodiments 30-34, wherein the clay treated natural gas condensate fraction comprises 35 wt % or less of isoparaffins, or 30 wt % or less; or wherein the clay treated natural gas condensate fraction comprises 25 wt % or more of naphthenes, or 30 wt % or more; or wherein the clay treated natural gas condensate fraction comprises 10 wt % or more of aromatics, or 12 wt % or more; or a combination thereof.

Embodiment 36

A residual fuel or fuel blending product comprising 75 vol % or more of a plurality of natural gas condensate resid fractions, the residual fuel or fuel blending product comprising a density at 15° C. of 920 kg/m$^3$ or less (or 875 kg/m$^3$ or less), a sulfur content of 1000 wppm or less, a pour point of 15° C. or less, and a CCAI of 820 or less (or 800 or less), a first natural gas condensate resid fraction of the plurality of natural gas condensate resid fractions comprising 30 vol % or more aromatics, a second natural gas condensate resid fraction of the plurality of natural gas condensate resid fractions comprising 70 vol % or more saturates.

Embodiment 37

A method for forming a residual fuel or fuel blending product, comprising blending a plurality of natural gas condensate resid fractions, the residual fuel or fuel blending product 75 vol % or more of the plurality of natural gas condensate resid fractions, the residual fuel or fuel blending product comprising a density at 15° C. of 920 kg/m$^3$ or less (or 875 kg/m$^3$ or less), a sulfur content of 1000 wppm or less, a pour point of 15° C. or less, and a CCAI of 820 or less (or 800 or less), a first natural gas condensate resid fraction of the plurality of natural gas condensate resid fractions comprising 30 vol % or more aromatics, a second natural gas condensate resid fraction of the plurality of natural gas condensate resid fractions comprising 70 vol % or more saturates.

Embodiment 38

The residual fuel or fuel blending product or method of any of Embodiments 36-37, wherein the residual fuel or fuel blending product comprises 5 vol % or more of the first natural gas condensate resid fraction and 5 vol % or more of the second natural gas condensate resid fraction; or wherein the residual fuel or fuel blending product comprises 75 vol % or more combined of the first natural gas condensate resid fraction and the second natural gas condensate resid fraction; or a combination thereof.

Embodiment 39

The residual fuel or fuel blending product or method of any of Embodiments 36-38, a) wherein the natural gas condensate resid fractions comprise non-hydroprocessed fractions, non-cracked fractions, or a combination thereof; b) wherein the natural gas condensate resid fractions comprise a sulfur content of 5000 wppm or less, or 1000 wppm or less, or 700 wppm or less; or c) a combination of a) and b).

Embodiment 40

A natural gas condensate fraction comprising a T10 distillation point of 350° C. or more (or 360° C. or more), a kinematic viscosity at 50° C. of 20 cSt or more (or 50 cSt or more, or 100 cSt or more, or 150 cSt or more), and a density at 15.6° C. of 850 kg/m$^3$ or more (or 880 kg/m$^3$ or more, or 900 kg/m$^3$ or more).

Embodiment 41

The natural gas condensate fraction of Embodiment 40, wherein the natural gas condensate fraction is formed by fractionation of a natural gas condensate comprising an API gravity of 45.0 or less (or 42.0 or less, or 40.0 or less).

Embodiment 42

A method for forming a natural gas condensate fraction, comprising: fractionating a natural gas condensate comprising an API gravity of 45.0 or less (or 42.0 or less, or 40.0 or less) to form a natural gas condensate fraction comprising a T10 distillation point of 350° C. or more (or 360° C. or more), a kinematic viscosity at 50° C. of 20 cSt or more (or 50 cSt or more, or 100 cSt or more, or 150 cSt or more), and a density at 15.6° C. of 850 g/cm$^3$ or more (or 880 g/cm$^3$ or more, or 900 g/cm$^3$ or more).

Embodiment 43

The natural gas condensate fraction or method of any of Embodiments 40-42, wherein the natural gas condensate fraction further comprises a T50 distillation point of 440° C. or more (or 460° C. or more, or 480° C. or more); or wherein the natural gas condensate fraction comprises a T90 distillation point of 580° C. or more (or 620° C. or more, or 650° C. or more); or a combination thereof.

Embodiment 44

The natural gas condensate fraction or method of any of Embodiments 40-43, wherein the natural gas condensate fraction is formed by fractionation of a natural gas condensate comprising a T50 distillation point of 250° C. or more; or wherein the natural gas condensate fraction is formed by fractionation of a natural gas condensate comprising a T90 distillation point of 500° C. or more; or a combination thereof.

Embodiment 45

The natural gas condensate fraction or method of any of Embodiments 40-44, wherein the natural gas condensate fraction comprises 50 wt % or more aromatics (or 60 wt % or more).

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

The invention claimed is:

1. A marine distillate fuel or fuel blending product, comprising 5 vol % to 70 vol % of a natural gas condensate resid fraction, and 5 vol % to 70 vol % of a distillate fraction, the marine distillate fuel or fuel blending product comprising a density at 15° C. of 860 kg/m$^3$ or less, a sulfur content of 5000 wppm or less, a pour point of 0° C. or less, and a cetane index of 35 or more, the natural gas condensate resid fraction comprising a density at 15° C. of 925 kg/m$^3$ or less and a pour point of less than or equal to 15° C.

2. The marine distillate fuel or fuel blending product of claim 1, wherein the natural gas condensate resid fraction comprises 70 vol % or more of saturates, or wherein the marine distillate fuel or fuel blending product comprises a cetane index of 35 or more.

3. The marine distillate fuel or fuel blending product of claim 1, wherein the marine distillate fuel or fuel blending product comprises a kinematic viscosity at 50° C. of 12 cSt or less.

4. The marine distillate fuel or fuel blending product of claim 1, wherein the marine distillate fuel or fuel blending product further comprises 8 vol % or more of a hydroprocessed resid boiling range fraction optionally comprising a kinematic viscosity at 50° C. of 200 cSt or less.

5. The marine distillate fuel or fuel blending product of claim 1, wherein the marine distillate fuel or fuel blending product comprises a sulfur content of 1000 wppm or more, or wherein the marine distillate fuel or fuel blending product comprises a sulfur content of 2000 wppm or less.

6. The marine distillate fuel or fuel blending product of claim 1, wherein the distillate fraction comprises a hydroprocessed distillate fraction.

7. The marine distillate fuel or fuel blending product of claim 1, a) wherein the natural gas condensate resid fraction comprises a non-hydroprocessed fraction, a non-cracked fraction, or a combination thereof; b) wherein the natural gas condensate resid fraction comprises a sulfur content of 1000 wppm or less; or c) a combination of a) and b).

8. A method for forming a marine distillate fuel or fuel blending product, comprising blending 5 vol % to 70 vol % of a natural gas condensate resid fraction with 5 vol % to 70 vol % of a distillate fraction, the marine distillate fuel or fuel blending product comprising a density at 15° C. of 860 kg/m$^3$ or less, a sulfur content of 5000 wppm or less, a pour point of 0° C. or less, and a cetane index of 35 or more, the natural gas condensate resid fraction comprising a density at 15° C. of 925 kg/m' or less and a pour point of less than or equal to 15° C.

* * * * *